US011072993B2

(12) United States Patent
Thoresen et al.

(10) Patent No.: US 11,072,993 B2
(45) Date of Patent: Jul. 27, 2021

(54) SYSTEM FOR MANIPULATING SUBSEA EQUIPMENT AND CONTROLLING A SUBSEA BARRIER SYSTEM

(71) Applicant: FMC Kongsberg Subsea AS, Kongsberg (NO)

(72) Inventors: Jon Thoresen, Kongsberg (NO); Harald Bjørn Hansen, Kolsås (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 0 days.

(21) Appl. No.: 15/527,004

(22) PCT Filed: Nov. 13, 2015

(86) PCT No.: PCT/EP2015/076590
§ 371 (c)(1),
(2) Date: May 15, 2017

(87) PCT Pub. No.: WO2016/075300
PCT Pub. Date: May 19, 2016

(65) Prior Publication Data

US 2017/0321517 A1 Nov. 9, 2017

(30) Foreign Application Priority Data

Nov. 14, 2014 (NO) ..... 20141367
Apr. 9, 2015 (NO) ..... 20150403

(51) Int. Cl.
*E21B 34/04* (2006.01)
*E21B 33/035* (2006.01)
(Continued)

(52) U.S. Cl.
CPC ..... *E21B 34/04* (2013.01); *E21B 33/0355* (2013.01); *E21B 41/0007* (2013.01); *E21B 43/01* (2013.01); *E21B 2200/06* (2020.05)

(58) Field of Classification Search
CPC .. E21B 34/04; E21B 33/0355; E21B 41/0007; E21B 43/01; E21B 2043/007
(Continued)

(56) References Cited

U.S. PATENT DOCUMENTS

2008/0264646 A1 10/2008 Sten-Halvorsen et al.
2010/0071775 A1 3/2010 Ratcliffe
(Continued)

FOREIGN PATENT DOCUMENTS

GB 2486970 A 7/2012
WO WO 2006/099316 A1 9/2006
(Continued)

OTHER PUBLICATIONS

Stair et al., "Riserless Subsea Completion with Disappearing Plug Technology," SPE 77712, Sep. 2002.
(Continued)

*Primary Examiner* — Matthew Troutman
*Assistant Examiner* — Patrick F Lambe

(57) ABSTRACT

—a subsea pump (30) arranged in fluid connection with the well interior (38, 39) providing a closed system suitable for pressure and flow regulation and establishing a temporary fluid flow between the subsea pump and the well interior, —a fluid source (31) supplying fluid to the subsea pump, wherein the subsea pump has a mode of operation for regulation of the flow and/or pressure between the pump and the well interior to operate equipment arranged in the well, —a safety control system for controlling shut down of a valve arrangement in a subsea position, which safety control system is also arranged in a subsea position and comprises a control unit (60) and an actuation unit (70) for local control and operation of the valve arrangement, —the valve arrangement is operated by the control unit into a valve configuration providing a barrier system between a reservoir in fluid
(Continued)

communication with the well interior and the surroundings, —a plurality of sensors (100, 51, 52) arranged for measuring fluid parameters transmitted as signals to the control unit, which also receives other signals from subsea and or topside locations, where the control unit is configured such that when at least one transmitted signal deviates from allowable value the control unit activates the actuation unit for the closing of the valve arrangement. The invention also concerns a method.

16 Claims, 12 Drawing Sheets

(51) Int. Cl.
*E21B 41/00* (2006.01)
*E21B 43/01* (2006.01)

(58) Field of Classification Search
USPC ..... 166/350
See application file for complete search history.

(56) References Cited

U.S. PATENT DOCUMENTS

2011/0114329 A1* 5/2011 Emecheta ..... E21B 33/0355 166/350
2011/0270431 A1 11/2011 Holley et al.
2012/0111573 A1 5/2012 Bhat
2014/0299801 A1 10/2014 Alred et al.

FOREIGN PATENT DOCUMENTS

WO WO 2010/020956 A2 2/2010
WO WO 2010/032019 A1 3/2010
WO WO 2011/128355 A2 10/2011
WO WO 2014/074685 A1 5/2014

OTHER PUBLICATIONS

Nellessen, "Development of a Deepwater Subsea Well Intervention Package Control System," OTC 20438, May 2010.
Stawaisz et al., "API 17G Specification for Subsea Well Intervention Equipment," OTC-25402-MS, May 2014.
Norsok Standard Common Requirements, "Subsea Production Control Systems," U-CR-005, Rev. 1, Jan. 1995.

* cited by examiner

TIWO WCU on 7" HXT Fluid schematics Rev 24 March 2015

SYSTEM FOR MANIPULATING SUBSEA EQUIPMENT AND CONTROLLING A SUBSEA BARRIER SYSTEM

FIELD OF THE INVENTION

The invention concerns a method for manipulating of equipment in a well and for controlling a barrier system. The manipulating of equipment in a well, may for instance comprise removing or manipulatively closing/opening a barrier assembly in a well. The invention also concerns a system arranged for temporary fluid connection to a manipulate equipment such as a barrier assembly in a well.

Prior to the start up of production from or into a well, it is necessary to carry out function and barrier testing to check the correct installment of various well equipment such as valves, actuators and down hole instrument. After completing the testing the equipment such as a barrier assembly needs to be removed before starting production in the well or starting injection in a well.

The barrier assembly may be provided by valves or by a destroyable tubing plug arrangement or by other means which is pressure responsive for instance to a specific sequence of pressures or flow. In accordance with one method for opening a barrier assembly a sequence of pressure working on the barrier assembly causes the opening of the barrier assembly so that fluid flow is allowed through the well interior area.

The inventive method and system may be employed for both opening and closing of equipment installed in the well.

BACKGROUND OF THE INVENTION

For manipulating of equipment such as removal or opening of the barrier assembly various methods are known. A retrieval tool such as a pulling tool may be used for removing barrier assembly. The retrieval tool needs to be inserted through the X-mas tree and the barrier valves in the X-mas tree.

Other methods for opening or removing the barrier assembly include providing means capable of destroying the barrier assembly such as explosives and procedures for opening the barrier assembly by providing a series of pressures to open or destroy the barrier assembly.

When employing a retrieval tool for removing a barrier assembly such as a plug, the retrieval tool is lowered through the X-mas tree on a wireline or a coiled tubing and installed in retrieval position. The removal of the barrier arrangement by allowing access of a retrieval tool through the X-mas tree requires that a cutting tool is provided in case of an emergency shut down of the well, thereby increasing the installation time and the complexity of the operation.

The publication SPE 77712 "Riseless Subsea Completion with Disappearing Plug Technology" by Spair, Shell International, Stuckey et al October 2002 discusses the possibility of providing cyclic pressure for sequential opening of the barrier assembly. The pressure pulses are provided by the use of fluid from a fluid line extending from a top side facility for instance a vessel to the sea floor or from a service line such as a chemical injection line. The fluid of fluid line is pressurized to produce a number of pressure cycles which are applied to a multi cycle tool for opening an isolation valve.

The removal of the barrier arrangement in accordance with the prior art solutions, and especially the procedures requiring access of a tool through the X-mas tree, is considered time consuming and as it is important to reduce installation time and also to simplify and reduce the operation procedure to prepare the well for production.

It is an object of the invention to provide an alternative solution to the above mentioned prior art procedure for manipulating of equipment in a well and controlling the barrier system. It is a further object that solution is time efficient, reliable and simple to operate. The method and the system in accordance with the invention reduces the total installation time compared to prior art solution and aims to provide a solution avoiding the disadvantage of prior art such as having to access a tool through the X-mas tree. Further the invention aims to reduce the number of operational steps necessary for completion of the well.

It is further an object of the invention to provide a solution for operative well control in an easy and flexible manner from a light vessel.

The inventive method and system may be used with a subsea tool providing the equipment necessary for preparing the well for production and thereby making the overall procedure for preparing the well for production more efficient.

Such a subsea tool may be arranged for the installation of subsea equipment such as a X-mas tree in addition to opening the barrier assembly, or may be prepared for carrying out other operations on a X-mas tree already installed.

Several attempts have been made to provide solutions where several operational tasks in preparing the well for production, have been combined by the use of a single installation tool. WO2011128355 shows an example of an installation tool capable of both installation and testing of a X-mas tree. In accordance with this system a ROV is provided arranged for connecting with the tool for installation and testing of the X-mas tree. The ROV supplies electrical and optical control signals from a top side location to the well head assembly for testing connections, valves and communication with sensors. An umbilical extending from a top side location feeds electrical and optical control signals to the ROV The inventive solution as such concerns further preparation of the well after installation and testing of the X-mas tree and provides a solution for opening and closing of equipment in the well, such as for instance the opening or removal of barrier arrangement in the well.

WO 2010032019 describes installation and testing of a X-mas tree similar to that of WO2011128355. WO 2010032019 discloses a tree running tool which may be controlled by a ROV. The tree running tool also includes a tool for retrieval of a plug from a well. The plug is retrieved by lowering the tool by a wire through the tree production bore onto the plug upper surface. The retrieval tool is actuated into retrieval position for removing the plug by applying hydraulic pressure onto an upper mandrel of the retrieval tool. The procedures of WO 2010032019 include that of removing a barrier arrangement embodied as the plug by employing a specialized retrieval tool to be brought into engagement with the plug for the plug to be removed. Further, the retrieval tool as described in WO 2010032019 is lowered through the X-mas tree and this procedure premediates the presence of a cutting tool and the additional equipment for operation of the cutting tool.

SUMMARY OF THE INVENTION

The independent claims define a system and method for manipulating equipment in a well and controlling a barrier system. The dependent claims define advantageous embodiments of the invention as defined in the independent claims.

In accordance with the invention a system and a method applicable for manipulation of various equipment arranged in a well is provided. This may be a barrier arrangement, and the manipulation may include controlling the opening and or closing of the equipment. i.e. barriers. The barrier arrangement may be arranged to provide at least two separate barriers between the reservoir and the surroundings, such as for instance destroyable plugs or valves suitable for opening by pressure or flow control. These plugs may be provided as an upper tubing hanger plug and a lower tubing hanger plug or a tubing hanger plug and a lower set plug or valve in the well. The inventive system and method is also applicable for manipulation of down hole well equipment such as sliding sleeves receptive to pressure or flow control.

Whereas systems in accordance with prior art have suggested the use of pressurized fluid supplied in a fluid line from the surface into the well interior in order to remove a barrier arrangement, the invention provides a subsea pump for the regulating the flow and/or pressure of the fluid in the well interior and thereby operate the down hole equipment. Such a solution would give a much more efficient solution for operating the downhole equipment, as pressurizing a smaller amount of fluids/liquid is favorable to pressurizing a larger amount of fluids/liquid, both in relation to consumed time and also accuracy.

The invention provides a system for manipulation of equipment arranged in a well and controlling a barrier system. The equipment may comprise down hole equipment and the manipulation of the down hole equipment may comprise for instance removing or opening/closing a barrier assembly comprising plugs and or valves. The system further comprises a subsea pump and a fluid source supplying fluid to the subsea pump. As an alternative to the subsea pump an accumulator may be provided or other apparatuses which are capable of providing a regulation of a higher pressure flow and/or pressure of a fluid. Thus in the following, the technical features and function of the subsea pump also applies to the aforementioned alternative apparatus.

The subsea pump is to be arranged in fluid connection with the well interior to establish a temporary fluid flow between the subsea pump and the well interior. The subsea pump, fluid source, fluid connection and well interior, is then provided as a closed system suitable for pressure and flow regulation. The subsea pump has a mode of operation for regulation of the flow and/or pressure between the pump and the well interior to operate the equipment arranged in the well interior. The subsea pump may have a mode of operation for regulation of the flow and/or pressure of the pumping fluid at the outlet of the pump and to forward this regulation of the flow and/or pressure to the fluid of the well interior through the fluid connection.

Accordingly the operation of the subsea pump controls the operation of the equipment such as the down hole equipment in the well interior.

Compared to carrying out such operations by for instance fluid from a fluid line extending to a top a location, the use of a subsea pump to operate down hole equipment is a versatile solution which provides the possibility of installing the subsea pump at various location and at the same time obtaining improved control of the operation.

The system in accordance with the invention further comprises a safety control system for controlling shut down of a valve arrangement in a subsea position, which safety control system is also arranged in a subsea position and comprises a control unit and an actuation unit for local control and operation of the valve arrangement.

The valve arrangement of the inventive system is operated by the control unit into a valve configuration providing a barrier system such as a temporary barrier system between a reservoir in fluid communication with the well interior and the surroundings. This provision of the barrier system may be carried out during or after manipulating the equipment. The valve arrangement provides a barrier by the closing of at least one valve of the valve arrangement, and in other circumstances closing at least two of the valves of the valve arrangement.

The inventive system further comprises a plurality of sensors arranged for measuring fluid parameters transmitted as signals to the control unit. The control unit also receives other signals from subsea and or topside locations, where the control unit is configured such that when at least one transmitted signal deviates from allowable value the control unit activates the actuation unit for the closing of the valve arrangement.

Topside location may be a marine vessel or even in some circumstances land based facilities from where the well control may be provided by an overall operation module arranged in communication with the control unit and the actuation unit (arranged subsea and provided for local control and operation of the valve arrangement). The inventive system makes it possible to provide operative control of the well from a vessel such as a lighter vessel.

The control unit may be provided on a skid positioned on the top of a X-mas tree. In another application the control unit may be provided on a skid positioned away from a X-mas tree but proximate to the well. Further the control unit may be provided on a skid positioned at a manifold. The control unit may also be provided on an ROV.

The actuation unit of the safety control system may be provided at the same location as the control unit. Alternatively the actuation unit may be located at a different location. The actuation unit may be arranged on a X-mas tree, in the X-mas tree configuration such as for instance the X-mas tree control module, which actuation unit is arranged for communication with the control unit for instance through signal lines connecting the actuation unit to control unit.

The actuation unit may be provided as a quick dump valve unit for dumping a control fluid from a valve control unit such as a pressure source unit or a spring unit of the at least one valve of the valve arrangement, thereby causing the valve to go to a fail safe close position.

The skid with the control unit attached may be provided as a subsea tool, possibly a running tool for setting and or removing a X-mas tree, including testing the X-mas tree.

In one embodiment the valve arrangement may be provided by at least one of the barrier valves of the X-mas tree, where the control and operation of the at least one barrier valves is done by the control unit and the actuation unit of the system according to the invention, instead of the ordinary control unit for the X-mas tree.

According to another aspect at least one of the barrier valves of the valve arrangement controlled by the control unit and operated by the actuation unit, may be provided on the skid with the control unit, temporarily connected to the well.

The barrier system may then be provided by the barrier valves of the Xmas tree or barrier valves arranged on the subsea tool for instance a running tool. Alternatively the barrier system may be provided by a combination of barrier valves on the X-mas tree and on the subsea tool.

The control unit may be arranged for receiving operation signals from a topside location during operations, through an umbilical or through wireless system.

The control unit may be arranged to receive signals from a topside location through the communication system of an ROV which is connected to the control unit during operation. The pump may be located on a ROV, and the fluid connection is provided by fluid lines between the ROV and the interior of the well. A ROV may be arranged to control the valve arrangement by the control unit arranged on the ROV. Power to the pump of the system, electric or hydraulic may be provided through the connected ROV.

The subsea pump may for instance be arranged on a subsea tool to be installed proximate to the well, thereby positioning the subsea pump in a operation position close to the well, another alternative is providing the pump on a separate skid landing on the seabed close to the pump, or provide the pump on a X-mas tree running tool or provide the pump on an ROV which is connecting up to a tool on the subsea installation. An ROV may be provided for operation of the subsea tool. The system may be arranged for attaching a ROV to the subsea tool and connecting a signal line between the ROV and the subsea tool, where an ROV umbilical is used for sending signals to operate the running tool. By this arrangement there is no need for an additional umbilical for operation of the subsea tool. The ROV umbilical transmits the power, communication and possible video images to a remote control station for instance at a topside location or principle also on shore. The control station may be provided by a hand carried operator control station or integrated in an existing ROV control station.

The ROV may be arranged to the control the valve arrangement. Further the ROV may be arranged to control the working of the subsea pump.

Other options include as mentioned above arranging the pump temporary or permanently at the seabed or at the manifold. When positioning the pump at a subsea manifold, a valve arrangement of the subsea manifold may be used for controlling the fluid flow between the pump and the well interior and may also be used to establish a barrier control between the reservoir and the surroundings ie providing the valve arrangement in the system according to the invention The pump may also be located on a ROV or at other suitable subsea locations. When arranging the pump on the ROV this may include connecting the ROV to the subsea tool thereby providing fluid connection between the ROV and the subsea tool and through this the well interior. One option is also to provide the elements of the system on the ROV, omitting a tool as such but connecting the ROV to the X-mas tree directly.

While the pump is located subsea for controlling the operation of down hole equipment arranged in the well, the fluid source supplying fluid to the pump may be located subsea or at a topside location such as on a vessel. When located subsea, the fluid source may be arranged at various sites such as on a subsea manifold or at the seabed supplying fluid to the pump. The fluid source arranged subsea is usually contained in a vessel which will need to be filled and/or refilled, and may for this purpose be arranged with a fluid line extending to a top side location for supplying fluid to the fluid source or at least have means for connecting such a fluid line. Other locations for the fluid source include locating the fluid source on the subsea tool or on the ROV. The fluid source may also be provided by fluid from a subsea service fluid line, thereby supplying fluid to the pump when needed.

When the down hole equipment is a barrier arrangement and the operation of the down hole equipment involves removing or opening barrier arrangement, it is necessary to provide an alternative barrier system to replace the barriers removed in order to fulfill safety regulations requiring that a single or double barriers should be provided between the reservoir and the surroundings. These alternative barriers will be provided by the valve arrangement in the system such as closing barrier valves of the Xmas tree or by closing barrier valves otherwise controlling the fluid flow through the fluid connection with the well interior, hence arranged on the subsea tool, or a combination of valves on the X-mas tree and the subsea tool.

The inventive method for manipulating equipment in a well and controlling a barrier system may be provided for carrying out the specific task of operating the down hole equipment arranged in the well such as for instance removing or opening a barrier element.

In accordance with the invention the method comprises the following steps:

providing a pump subsea proximate the well and providing a fluid source supplying fluid to the pump, establishing a fluid connection for fluid flow between the subsea pump and the well interior which is provided as a closed system suitable for pressure and flow regulation, operating the pump to regulate the flow and/or pressure between the pump and the well interior, thereby regulating the flow and/or pressure of the fluid in the well interior for controlling the operation of the equipment arranged in the well, providing a temporary safety control system in a subsea position comprising a control unit and an actuating unit for locally controlling and operating a valve arrangement which is positioned subsea operating the valve arrangement by the control unit into a valve configuration providing a barrier system between a reservoir in fluid communication with the well interior and the surroundings, arranging the control unit for receiving signals representing measured fluid parameters and also other signals from subsea and or topside locations, and when at least one signal deviates from an allowable signal value, operating the actuating unit to switch from a normal operating mode to a well shut down mode by closing the valve arrangement thereby forming a barrier between the reservoir and the surrounding.

The equipment in the well may comprise a barrier assembly wherein the pump has a mode of operation generating pressure buildt up through the fluid connection into the well interior for pressurization of the fluid of the well interior with pressure necessary to operate the barrier assembly in the well interior during the temporary fluid flow between the pump and the well interior, thereby opening barrier equipment in the well, as plug or valves.

After completing the method for manipulating equipment in the well, steps for closing the fluid connection between the pump and the well interior may be carried out.

The pump may be operated to regulate the flow and/or pressure in the pumped fluid flowing from the pump into the well interior through the fluid connection. The equipment in the well may comprise down hole equipment arranged in the well.

The step of operating a valve arrangement by a control unit into a valve configuration arranging a barrier system between a reservoir in fluid communication with the well interior and the surroundings may be carried out during manipulating equipment in the well.

The barrier system may be provided by closing at least one valve of the valve arrangement, and in most circumstances closing at least two of the valves of the valve arrangement in accordance with the invention.

During the operation of the pump for controlling the operation of down hole equipment, the system and the method may be arranged so that the pumped fluid flows into the well interior and flows back out from the well interior in a repeating or alternating manner. By this the down hole equipment is operated with a sequence of pressure build ups in the well interior. Preferably the volume of the pumped fluid and the fluid returning from the well interior will have the same or similar volume, otherwise there is provided control systems for shutting down the well.

The pump may be arranged on a subsea tool such as a running tool and the barrier system for instance double barriers may be provided by the valve arrangement arranged on the subsea tool or by another valve arrangement such as the valve arrangement of the Xmas tree or a combination of both valve assemblies. The pump arranged on the subsea tool and the valve arrangement provided on the subsea tool together with the pump controls the fluid flow and or pressure through the fluid connection when the subsea tool is arranged at a subsea installment position. When arranging the pump on the subsea tool and positioning the pump proximate the well by installing the subsea tool at a subsea installment position, the fluid flow through the fluid connection will be controlled by operating the pump and the valve arrangement (on the subsea tool or by the valve arrangement of the Xmas tree or the combined operation of valve arrangement on the subsea tool and the valve arrangement of the Xmas tree).

Arranging the pump on the subsea tool at the proximity of the well, provides an efficient solution and enables improved control of the operation as the means for pressurizing element closer to the equipment thereby reducing time for building the necessary pressure at the down hole equipment and reducing the uncertainties in the procedure. If the pump is to be positioned proximate to the well on a subsea tool which may also be used for carrying out other necessary well related procedures, as setting and testing a X-mas tree this will additionally save installation time and costs. By adding the possibility of operating the down hole equipment arranged in the well to a subsea tool such as a running tool employed for instance for installing and testing Xmas tree on a subsea wellhead assembly, the total time for completion of the well for production may be reduced, thereby also saving well preparation installation costs.

Further possibilities include closing equipment in a well such as down hole barrier elements and retrieving the Xmas tree from installed position by the running tool.

The valve arrangement arranged on the subsea tool may comprise at least a pump barrier valve for controlling the flow of pumped fluid to the well interior and at least a return barrier valve to control the return of fluid from the well interior. As mentioned above the valve arrangement arranged on the Xmas tree may as an alternative serve the same purpose. This being the case since the method and system is operating down hole equipment without deploying tools on wire or cable or similar through the Xmas tree.

To fulfill the requirement for a double barrier system between the reservoir and the surroundings an additional pump barrier valve may be provided for controlling the flow of pumped fluid to the well interior and an additional return barrier valve may be provided to control the return of fluid from the well interior the valve arrangement. The additional pump barrier valve may be located on the subsea tool or on the X-mas tree. The additional return barrier valve may be located on the subsea tool or on the X-mas tree. The fluid connection between the pump and the well interior may be provided through a flow passage system in a Xmas tree installed on a subsea wellhead. The controlling of the fluid flow through the flow passage system may be carried out by the valve arrangement of the subsea tool or the Xmas tree, or the combination of both valve arrangements.

When the pump is arranged on the subsea tool or on an ROV connected to the subsea tool or on a separate skid with a fluid connection to the running tool, a flow passage allows the pumped fluid to flow from the pump through the subsea tool in direction of the well interior and a return passage in the tool directs the fluid flow returning from the well interior to the fluid source/subsea pump. A number of fluid lines arranged on the subsea tool and the opening and closing of a number of valves of the valve arrangement in predetermined configuration provides the fluid flow passage and the return passage of the subsea tool respectively. The pumped fluid may be then directed through the subsea tool following the flow passage provided by the fluid lines and the valve arrangement in a flow passage configuration of the valve arrangement. And the return fluid may returned to the fluid source/subsea pump following the return flow passage as by the fluid lines and the valve arrangement in a return passage configuration of the valve arrangement. Normally there will be sequences of pumping fluid/liquid into the well interior for building pressure/flow followed by release of the pressure in the interior of the well, by allowing fluid/liquid to return to the fluid source. The fluid entering and exiting the well interior will normally do this through the same flow passage, but then be directed through different flow passages in the tool. When the fluid connection between the pump and the well interior is provided through the flow passage system in the X-mas tree, the flow of the pumped fluid may follow a flow path flowing from the pump through the flow passage of the subsea tool and into a main bore of the flow passage system in the Xmas tree and into the well interior. The return of fluid from the well interior may flow through the same main bore of the flow passage system in the X-mas tree as it entered the well interior and into a return passage in the subsea tool. Following an alternative flow path the flow of the pumped fluid may be allowed through the pumped fluid passage of subsea tool and into an annulus bore of the X-mas tree through a cross over passage and into the well interior and allowing the return of fluid from the well interior back the same passage through the X-mas tree and into the return passage in the subsea tool. It is also possible to allow the pumped fluid to pass through the main bore and return in the annulus bore of the X-mas tree, or to allow the pumped fluid to pass through the annulus bore and return in the main bore of the X-mas tree.

The choice of flow path through the X-mas tree may be carried out by controlling the fluid flow through the valve arrangement of the subsea tool and the X-mas tree. And the control system of the tool may control both systems.

The fluid connection between the pump and the well interior may also be provided at the master/wing valve or downstream to Xmas tree.

The valve arrangement of a X-mas tree installed on a subsea wellhead assembly is operated by the subsea tool to control the fluid flow between the pump and the well interior through the flow passage system in the Xmas tree. As mentioned above the down hole equipment may comprise a barrier assembly, and the inventive system and method is applicable for opening or removing the barrier assembly, but may in principle also be employable for closing the barrier assembly. The barrier assembly may comprise various elements such as at least one destroyable plug and/or at least one pressure responsive valve unit.

To avoid the unintentional removal or release of at least one destroyable plug and/or at least one pressure responsive valve unit due to pressure variations in the well interior, the barrier assembly, plug and or valves are normally arranged with an activation mechanism which may be arranged as a multistep activation mechanism. Alternatively a system may be provided for release where there is a pressure build up threshold/flow kept for a given time to release or open the barrier/plug/valve. The activation mechanism, such as for instance a multistep activation mechanism, is arranged for releasing or removing/opening the responsive valve unit or destroyable plug after a predetermined pressure pattern is carried out by the pump and forwarded to the fluid of the well interior for the release of the activation mechanism to open or remove the barrier assembly. The predetermined pressure pattern as provided by the pump and forwarded to the fluid of the well interior may be arranged for the stepwise release of the multistep activation mechanism to open or remove the barrier assembly.

If the barrier assembly comprises a least one pressure responsive valve unit, the regulation of the pump may be used for closing the least one pressure responsive valve unit.

The predetermined pressure pattern as provided by the pump and forwarded to the fluid of the well interior may also be used to trigger a signal activation pattern for instance electric or magnetic signal for removing or opening of the barrier assembly. As such the multi step activation mechanism may be carried out as a signal controlled multi step activation mechanism controlling the release of the activation mechanism to open/close or remove the barrier assembly. The subsea pump has a mode of operation generating pressure built up through the fluid connection into the well interior for pressurization of the fluid of the well interior. During this mode of operation the fluid of the well interior may achieve a stepwise pressurization for operation of the barrier assembly in the well interior.

The subsea pump may be operated at intervals generating pressure build up in fluid in the well interior or flow in the well interior, thereby repeatedly activating a activation mechanism of the barrier assembly until opening the barrier assembly. Given that the barrier assembly is at least one pressure responsive valve unit or other equipment to be opened or closed, the barrier assembly may both be opened and closed in this manner.

When the barrier assembly comprises at least one destroyable plug; repeatedly activating the activation mechanism and thereby removing the at least one destroyable plug, wherein the activating of the activation mechanism may cause a final destroying of the at least one destroyable plug. The measured fluid parameters or other parameters essential to the working of the system are transmitted as signals to the control unit which is configured such that when one transmitted signal deviates from allowable signal value or signal value range the control unit activates the actuation unit for the closing of the valve arrangement, thereby providing barriers between the reservoir and the surroundings. The actuation unit may be provided to close the valve arrangement of the system away on the subsea tool and or of the X-mas tree.

The valves of the valve arrangement, which may act as barrier valves, each have a pressure source unit or a spring unit and a control fluid system is provided for operating of the valves. The control fluid flowing in the control fluid system exerts pressure on the valves to exceed the spring force of spring unit for opening the valves, during a normal flow mode, when the measured parameters do not deviate from the allowable value.

The control fluid system may be provided with a control valve (such as the quick dump valve) arranged at the actuation unit and arranged to control the opening of a dumping outlet of the control fluid system. The control valve has a closed position where the dumping outlet is closed thereby maintaining normal operation of the valves or the valve arrangement. The control valve has an open position wherein the dumping outlet is open draining the control fluid from the valves of the valve arrangement. The valves of the valve arrangement are then closed by the spring unit of each of the valve, thereby obtaining a shut down mode.

The control valve, quick dump valve, is brought into an open position initiating shut down mode if the measured parameters as pressure, flow, connection to ROV or other signals deviates from a predetermined value or value range, in which case there is no signal transmitted to the control valve of the actuation unit. The control valve, quick dump valve, needs an active signal from the well shut down unit to be kept closed, if signal is lost or disconnected by the well shut down unit, the valve will open and the well will be closed.

Above the inventive system and method has been described for manipulating equipment in a well and controlling a barrier system. The inventive system and method may be arranged so that the subsea pump has a mode of operation regulating the flow and/or pressure to provide suction or vacuum between the pump and the well interior. The capability of providing suction or vacuum is advantageous in various applications, but may be especially useful for removing hydrate plugs located in the well, down hole or in the X-mas Tree.

When applying the pump for removing hydrate instead of manipulating equipment in a well, the working of the pump is fitted especially for this purpose. However, the provision of the system and the method for removing hydrate instead of manipulating equipment in a well, define features of a principle inventive nature, that may function independent from the system and method as defined in the independent claims.

In this respect the principles of system and method may be defined as follows:

System arranged for removing hydrate in a well and controlling a barrier system, comprising a subsea pump arranged in fluid connection with the well interior providing a closed system suitable for pressure and flow regulation and establishing a temporary suction or vacuum between the subsea pump and the well interior, a fluid source supplying fluid to the subsea pump, wherein the subsea pump has a mode of operation for regulation of the flow and/or pressure between the pump and the well interior to remove hydrate in the well, a safety control system for controlling shut down of a valve arrangement in a subsea position, which safety control system is also arranged in a subsea position and comprises a control unit and an actuation unit for local control and operation of the valve arrangement, the valve arrangement is operated by the control unit into a valve configuration providing a temporary barrier system between a reservoir in fluid communication with the well interior and the surroundings, a plurality of sensors arranged for measuring fluid parameters transmitted as signals to the control unit, which also receives other signals from subsea and or topside locations, where the control unit is configured such that when at least one transmitted signal deviates from allowable value the control unit activates an actuation unit for the closing of the valve arrangement.

The system arranged for removing hydrate will be applicable by parts of the system as in the dependent claims and otherwise in the description.

Further the principles of the method:

Method for removing hydrate in a well and controlling a barrier system, comprising the following steps;

providing a pump subsea proximate to the well and providing a fluid source supplying fluid to the pump, establishing a fluid connection for fluid flow between the subsea pump and the well interior which is provided as a closed system suitable for providing a suction or vacuum, operating the pump to regulate the fluid flow and/or pressure between the pump and the well interior through the fluid connection, thereby regulating the flow and/or pressure of the fluid in the well interior for removing hydrate in the well, providing a temporary safety control system in a subsea position comprising a control unit and an actuating unit for locally controlling and operating a valve arrangement which is positioned subsea, operating the valve arrangement by the control unit into a valve configuration providing a barrier system between a reservoir in fluid communication with the well interior and the surroundings, arranging the control unit for receiving signals representing measured fluid parameters and also other signals from subsea and or topside locations, and when at least one signal deviates from an allowable signal value, operating the actuating unit to switch from a normal operating mode to a well shut down mode by closing the valve arrangement thereby forming a barrier between the reservoir and the surrounding.

Some aspects and embodiments of the method as described in the dependent claims and otherwise in the description are applicable for use with the principle method arranged for removing hydrate in a well as defined above.

With a system and method according to the invention one may establish a barrier control system which can be operated from a light vessel while still being within the requirements from the government or a government uthorites, such as the Petroleum Safety Authority.

As the skilled person will realize also other parameters than the ones exemplified here, may be used for indicating the status of the system, in which case the absence of signals from the control unit to the actuation unit causes the shut down mode and the presence of signals from the control unit to the actuation unit indicates normal flow mode.

DETAILED DESCRIPTION

In the following, embodiments of the invention will be described in detail with reference to the enclosed drawings, where:

FIGS. 10 through 12 shows typical configurations of the well opening system. Other configurations are possible.

Figure 1:
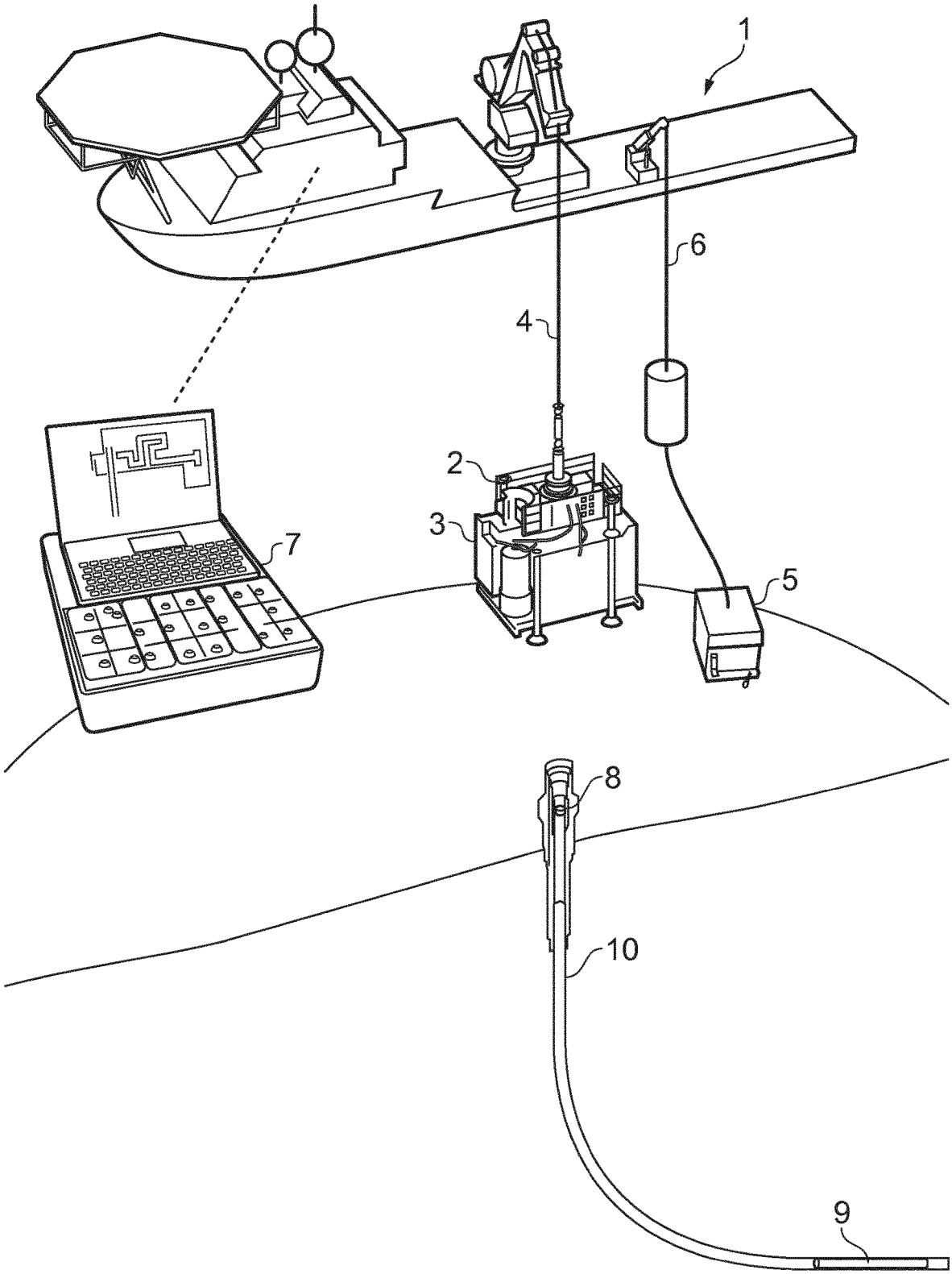
FIG. 1 shows an example of an overall view of one embodiment of the invention.

FIG. 1 shows a vessel 1 lowering a subsea tool 2 here shown as a running tool arranged with a X-mas tree 3 to be positioned at a subsea installation location for installing the X-mas tree 3 on a subsea wellhead assembly. The subsea tool 2 is lowered from the vessel 1 by a deployment line 4 such as a wire line. A remotely operated vehicle (ROV) 5 is provided for supplying power and control lines for the operation of the subsea tool during use. An umbilical 6 transmitting power, electrical and or optical signals are connected to the vessel 1 and the ROV 5 and transfers power, communication and or video images between the ROV and the vessel and thereby to the tool. An overall operation module 7 such as hand carried operator console controls the entire operation from a remote location, possibly from a top side location on the vessel 11, but it could also be at a remote location at land or in a ROV control cabin at the vessel. The ROV is therefore a carrier, carrying signal and or power between the operator and the running tool.

Equipment such as down hole equipment for instance a barrier assembly, here shown as an upper tubing hanger plug 8 and a lower set plug 9, is arranged in a well 10 and forms the barriers in the well before the installation of the X-mas tree or when the X-mas tree is removed to be maintained or replaced. The plugs 8 and 9 may be provided as disappearing plugs or alternatively one may have valves as barrier elements that are arranged to open and close for fluid flow in response to an activation mechanism operated by a pressure or flow sequence or levels in the fluid in well.

When the down hole equipment is a barrier assembly, the removal or opening of the barrier assembly is typically carried out by pressure build up or pressure variation generated by a pump arranged in fluid connection with the interior of the well 10.

The pump is to be provided subsea preferably proximate to the well or at least at a set distance compatible with providing an efficient fluid connection between the pump and well interior. The pump may favorably be positioned on the subsea tool arranged to be connected to a X-mas tree or on the ROV. A fluid source supplies fluid to the pump.

Figure 2:
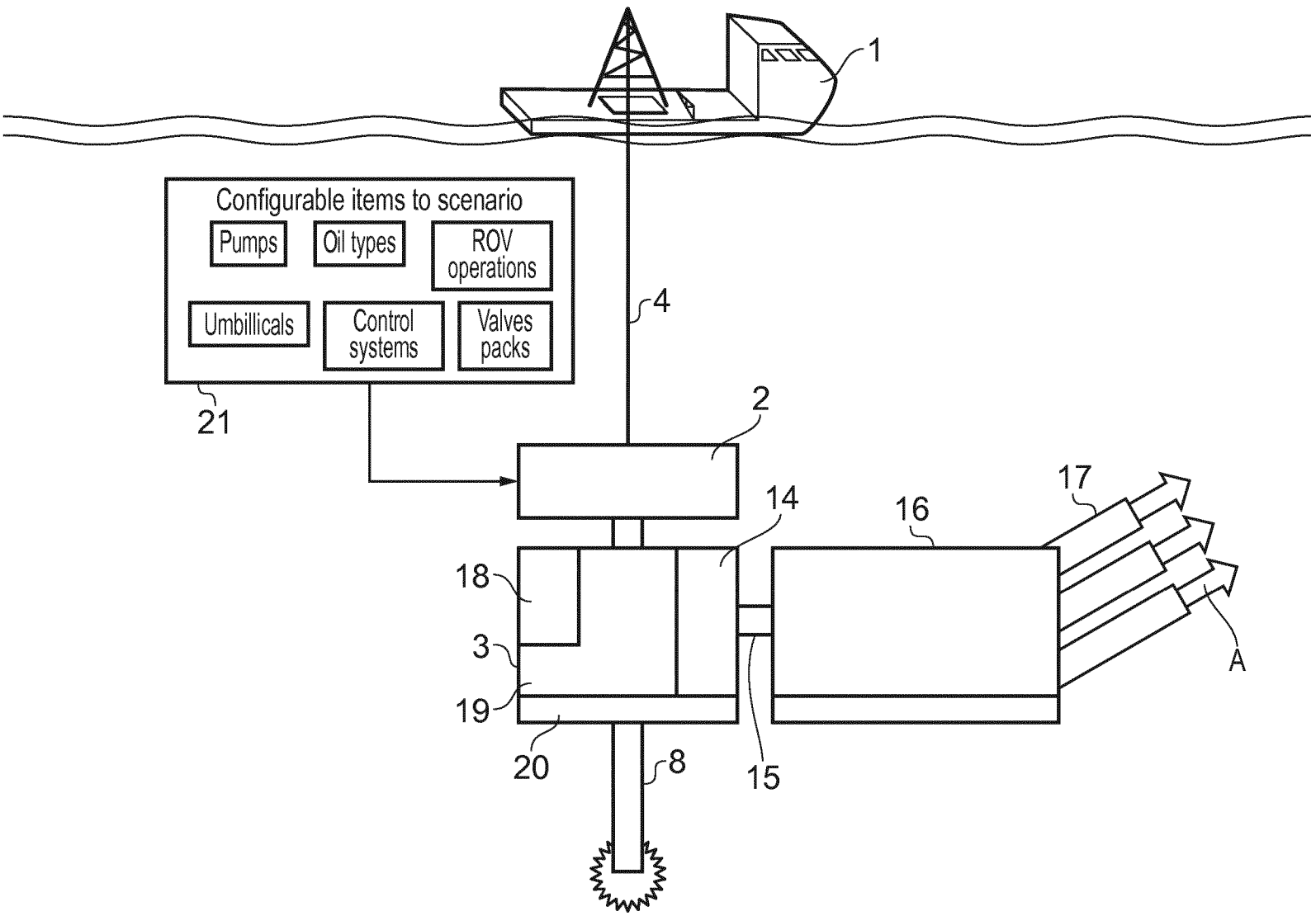
FIG. 2 shows an example of a subsea tool and a X-mas Tree installed on a well head.
Figure 3:
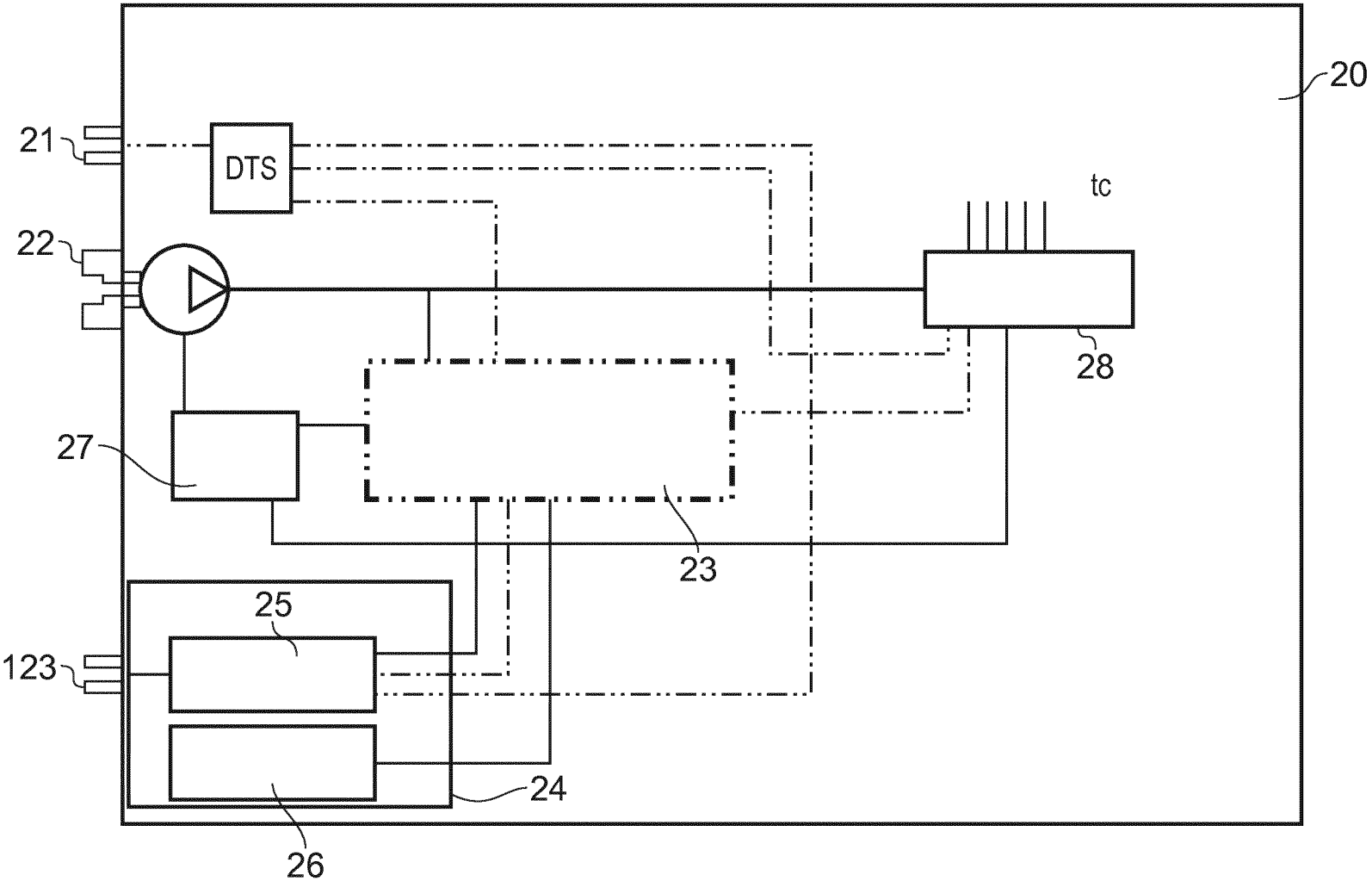
FIG. 3 shows a schematic layout of a subsea tool.
Figure 4:
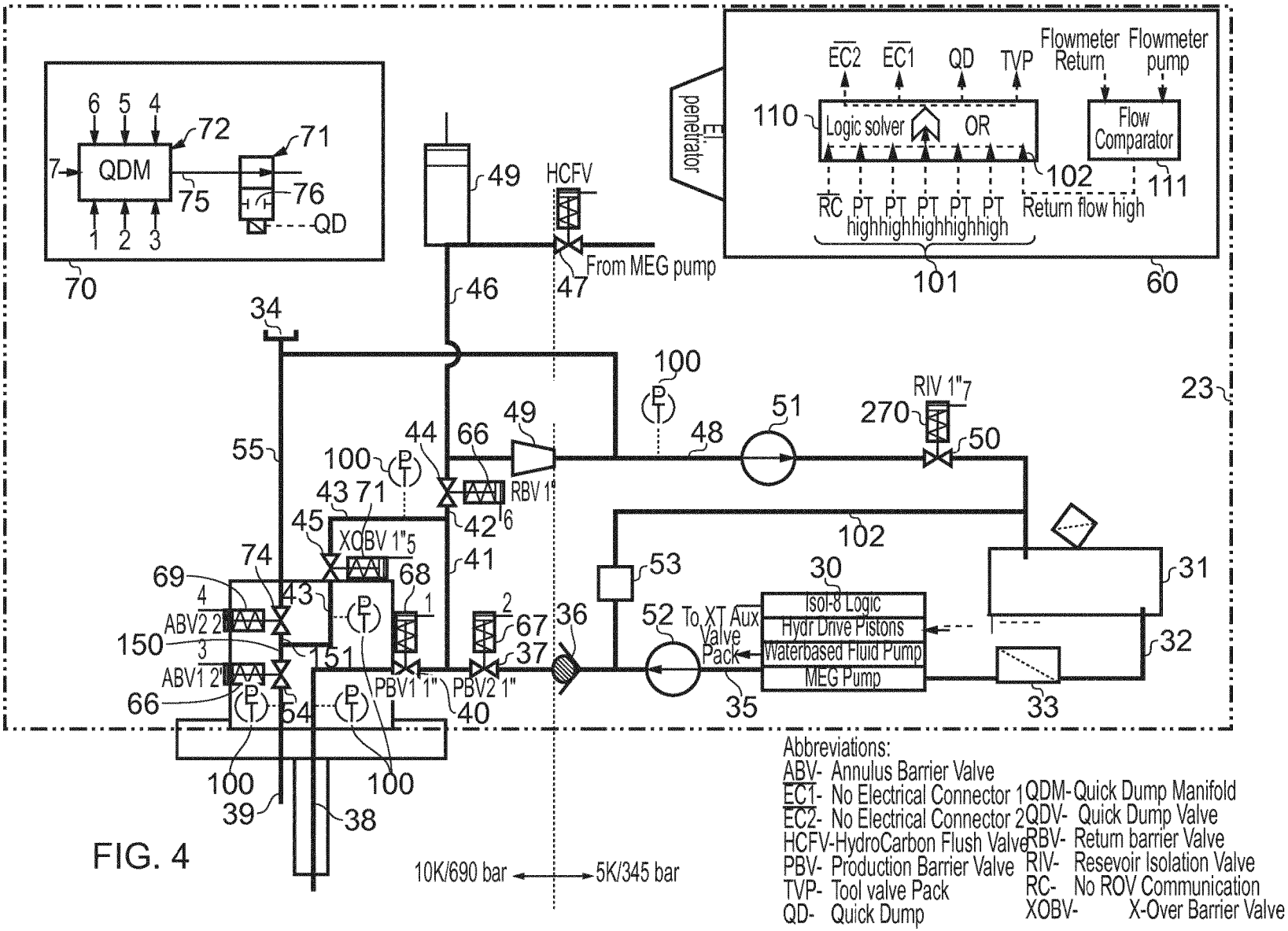
FIG. 4 shows an example of a well control unit to be included in a subsea tool.
Figure 5:
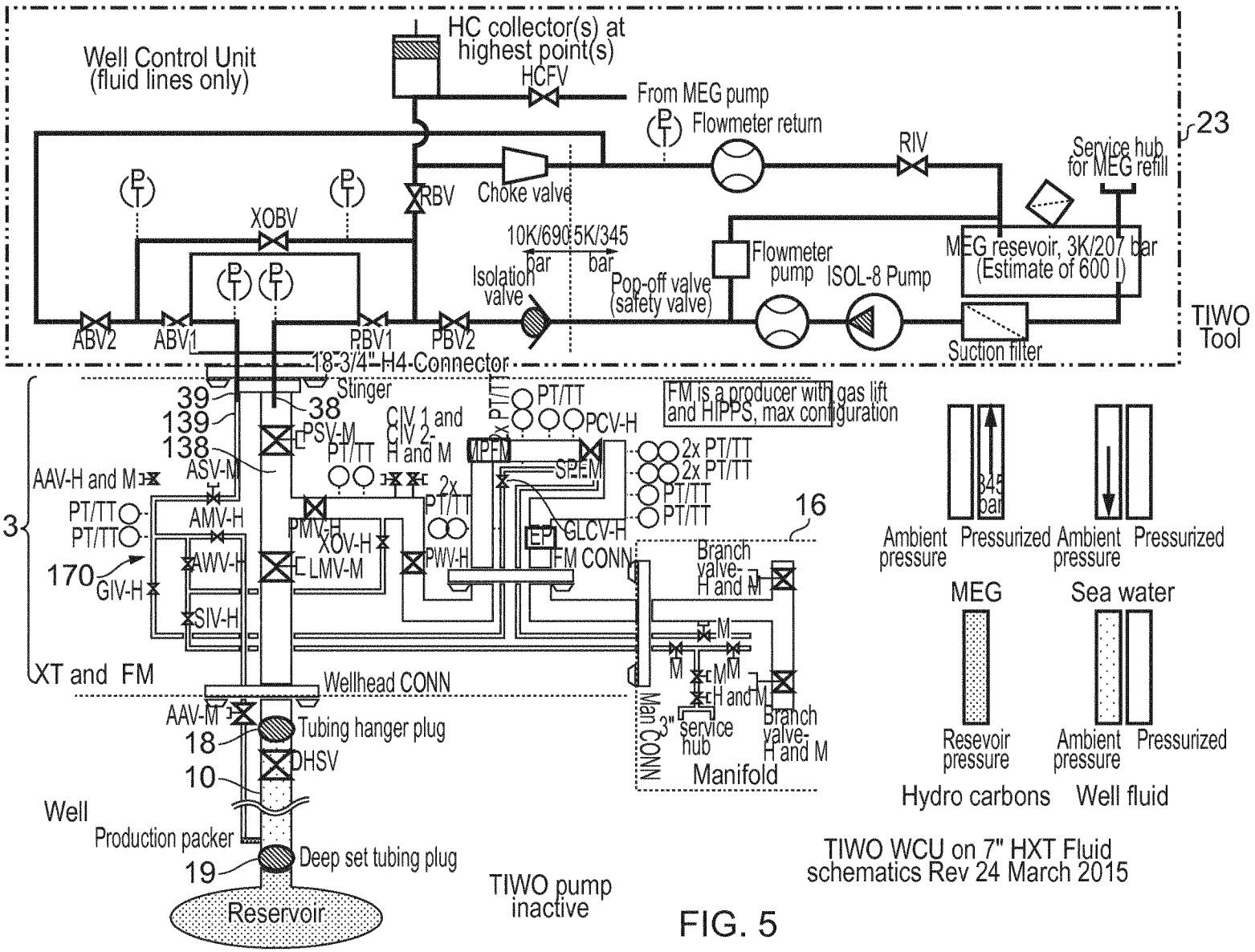
FIG. 5 shows an example of a well control unit connected to a X-mas tree installed on a well head, no pumping of fluid shown.

The pump 30 and the fluid source 31 may be arranged on the subsea tool 2 as illustrated on FIG. 3-5. Alternatively the pump may be arranged at a subsea location for instance at a manifold 16, see FIG. 2, or on the ROV. Further, the fluid source may be located at a subsea location and may be contained in a vessel and positioned on the manifold or the ROV. The fluid source may also be provided by a subsea service line, whereto the subsea tool may be connected for instance by a fluid line. Another possibility is to use a fluid source positioned at a topside location with a fluid line down to the tool.

The subsea tool 2 as shown in the figures is also capable of carrying the X-mas tree from the vessel during installation and have the provisions for setting, installing and testing the X-mas tree on the wellhead. Such provisions for setting, installing and testing the X-mas tree may be found in prior art and there are several publications describing different manners of doing such a procedure. The tool according to the invention may comprise one such system.

When the X-mas tree is installed on the wellhead, which may be done by the subsea tool according to the invention or the X-mas tree may be already installed and the subsea tool according to the invention is provided in the vicinity or at the X-mas tree, the next step is to open the well for production, by removing or opening the barrier assembly in the well, below the X-mas tree. When this can be done in one procedure this gives additional time and cost savings. However having the tool provide for opening of the barrier as such, provides cost savings and a more controlled operation.

When later retrieving the X-mas tree installed on the wellhead, down hole equipment such as a barrier assembly must be closed before removing the X-mas tree from the wellhead. The retrieval of the subsea tool requires that the valve arrangement such as barrier valves for the well, as for instance in the X-mas tree are closed before the retrieval is carried out. These precautionary measures for well safety ensure that a double barrier is established between the reservoir and the surroundings, before well related equipment such as a X-mas tree and a subsea tool is removed from the installation site.

When manipulating equipment in a well such as removing or opening the barrier assembly, the first step is to establish a temporary fluid connection for fluid flow between the subsea pump and the well interior providing a closed system suitable for pressure and or flow regulation. The subsea pump has a mode of operation for regulation of the flow and/or pressure of the pumping fluid at the outlet of the pump and to forward this flow and/or pressure regulation to the fluid of well interior through the fluid connection to operate the down hole equipment in the well interior during the temporary fluid connection between the pump and the well interior. When the down hole equipment is a barrier assembly the pump may be operated at intervals generating pressure build up in the pumped fluid flowing into the well interior through the fluid connection to produce pressure build up in the fluid of the well interior until opening the barrier assembly. The operation of the barrier assembly could be activated by an activation mechanism requiring a sequence of pressure build up, a number of pressure build up, a given threshold pressure for a given time period or pressure variations for activation. This arrangement is to prevent accidental activation of the equipment. After carrying out the activation or opening or closing of the down hole equipment the fluid connection between the pump and the well interior is then closed, establishing a barrier system around the reservoir upstream of the fluid connection between the pump and the well interior for a production well, terminating the temporary fluid flow between the pump and the well interior.

FIG. 2 illustrates the subsea tool 2 and the X-mas tree 3 installed on the well head assembly 8. A simplified concept of the main functions and the technical features of the X-mas tree 3 are illustrated in the FIG. 2 as concept modules. A main module 19 illustrates the actual X-mas tree, module 18 illustrates the subsea control of the X-mas tree 3. Module 14 is a flow module 14 arranged with a fluid line assembly 15 to a manifold 16. The manifold 16 is connected to a set of pipelines 17 for distribution of fluid to production facilities as illustrated by arrow A. A module 20 illustrates a permanent guide base comprising a conductor housing for receiving the well head. A further module 8 illustrates well head, tubing hanger and downhole equipment. Module 21 describes functions and technical features of the subsea tool 2.

The subsea tool 2 as shown in FIGS. 1 and 2 is provided for the installation of the X-mas tree 3, and as mentioned above the pump and possibly also the fluid source may be provided on the subsea tool 2. However, it is also possible in accordance with the invention to install the x-mas tree using a subsea tool 2 as shown in the figures and then to lower the pump along for instance arranged on a ROV which attached and connects to the subsea tool or without the fluid source as this may be taken from a service line subsea, or from an fluid line to the topside either attached to the subsea tool or to the ROV.

A schematic outlay 20 of a subsea tool is shown schematic in FIG. 3. The schematic outlay 20 is suitable for the subsea tool 2 used for the installation of a X-mas tree as illustrated in FIG. 1, but is also applicable for a subsea tool to be connected to an installed X-mas tree and for carrying out operations in the well interior in addition to the function and barrier testing of the X-mas tree.

The subsea tool has a ROV connector interface 21 for power and communication transmittal with or through the ROV and a shaft receptacle 22 for driving of a valve controlling pump provided for controlling flow and pressure of a control fluid for operating a valve arrangement such as barrier valves positioned on the running tool. The shaft receptacle 22 may alternatively be fluid connections or power connections depending on the type of valve controlling pump on the running tool. This valve controlling pump and the other pump as described in the following for regulating the flow and/or pressure of the fluid in the well interior may be a hydraulically and or electrically driven pumps. In the case where the valve controlling pump is positioned on the subsea tool there may be a power transmission to this pump but the fluid pump for the well interior fluid may receive a power transmission or fluid transmission if it is positioned on the subsea tool depending on how this is driven. If this pump for the fluid for the well interior is arranged in the ROV, there may be fluid line connections from the ROV to the tool Further an X-mas tree connector face 123 is provided for testing of the X-mas tree functionality and correct installment and a potentially replaceable adapter 24 for the X-mas tree comprising a valve pack 25 for the X-mas tree and a fluid reservoir 26 for operation or the installment and testing of the X-mas tree. The subsea tool according to the invention has a reservoir 27 for hydraulic fluids, a valve tool pack 28 for operating for instance barriers valve arranged on the tool and or at the X-mas tree, a well shut down unit 60 and a quick dump unit 70 for controlling the barrier valve arrangements such as illustrated in FIG. 4, the barrier valves being arranged at the subsea tool or the X-mas tree. This form part of a well control unit 23 for operating barrier valves in a manner for manipulating equipment in a well with the subsea tool and still keep full control of the well when opening downhole barrier assembly. The further details of the well control unit 23 is shown schematically in FIG. 4.

FIG. 4 shows an example of the subsea tool in fluid connection with the well interior through fluid connection between flow passages of the X-mas tree and the well control unit 23. The well control unit 23 of the subsea tool comprises a system comprising a number of fluid lines arranged and a number of valves of the valve arrangement arranged in these fluid lines which may be in an open or closed position to provide a flow passage and a return passage directing the fluid flow to and from the well interior.

The well control unit 23 comprises a pump 30 which extracts fluid from a fluid source 31 such as a MEG reservoir through a fluid source line 32 including a suction filter 33. The fluid source 31 has a fluid filling point 34. The pump 30 may also be arranged to draw fluid from different fluid sources with different parts of the pump, as indicated in the figure. The pump is operated to deliver pumped fluid to the well interior to regulate the flow and/or pressure of the fluid in the well interior for controlling the opening and closing of down hole equipment of the well.

The pumped fluid is discharged from the pump 30 and passed through a pump outlet fluid line 35 arranged with an isolation valve 36 and a pump barrier valve 37. A flow meter 52 is included in the pump outlet fluid line 35 for measuring of the characteristic of the pumped fluid flow. The pump barrier valve 37 is arranged in an open position to direct the pumped fluid flow to the well interior. The pumped fluid may enter the well interior following at least two different flow paths. The different flow paths are provided by opening and closing of the valve arrangement as shown in the well control unit 23.

In accordance with a first flow path for pumping fluid to the well interior and thereafter returning the fluid, the pumped fluid is allowed into a X-mas tree main bore fluid line 38 and the fluid returns through the same X-mas tree main bore fluid line 38. The fluid may be routed in a different manner in the return path in the tool. The X-mas tree main bore fluid line 38 leads the fluid to the main bore 138 of the X-mas tree 3, as illustrated by the connection of X-mas tree main bore fluid line 38 and the main bore 138 of the X-mas tree 3 as shown in FIG. 5, and from there into the interior of the well 10.

Figure 6:
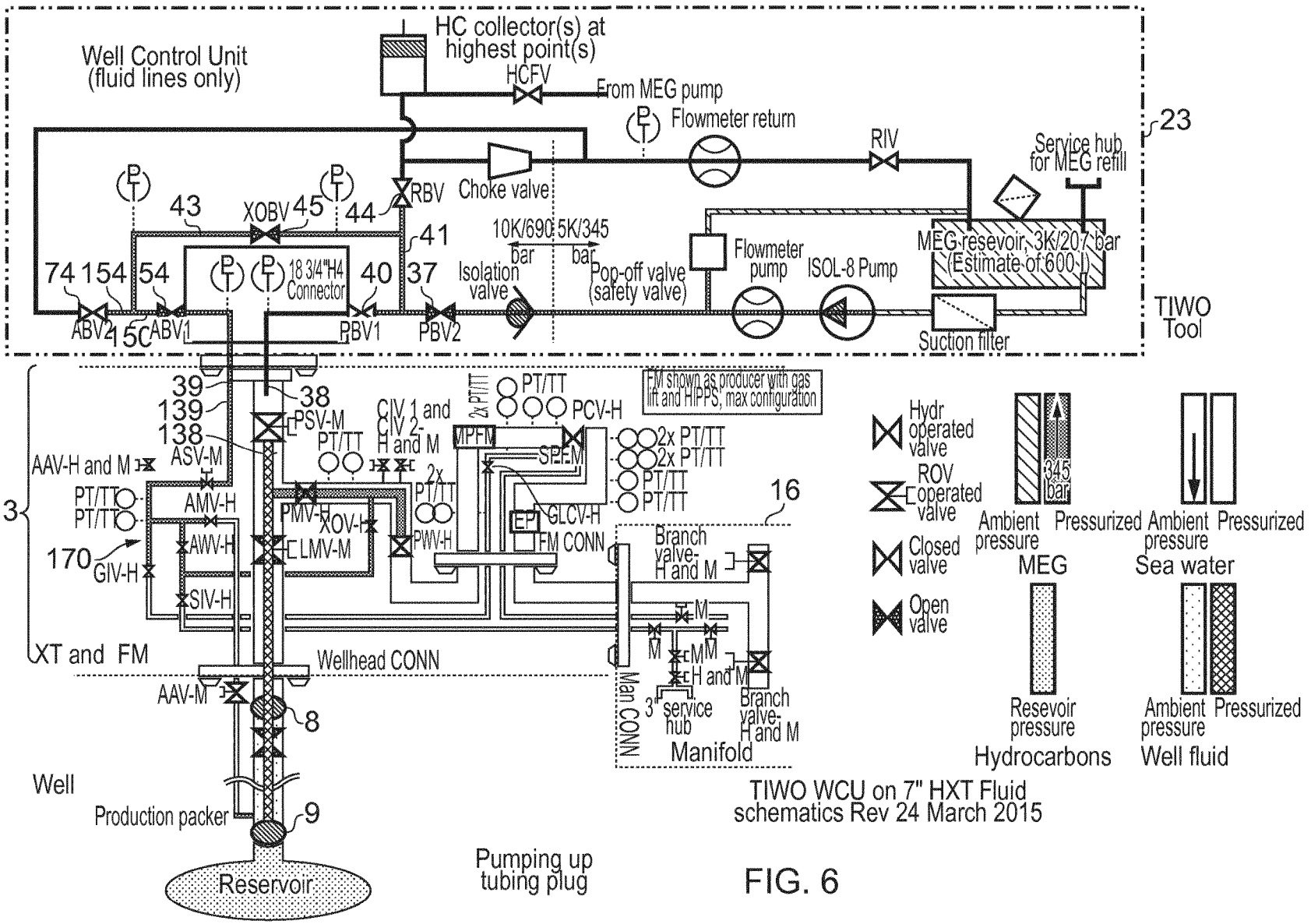
FIG. 6 illustrates the pumping of fluid into the well interior.
Figure 7:
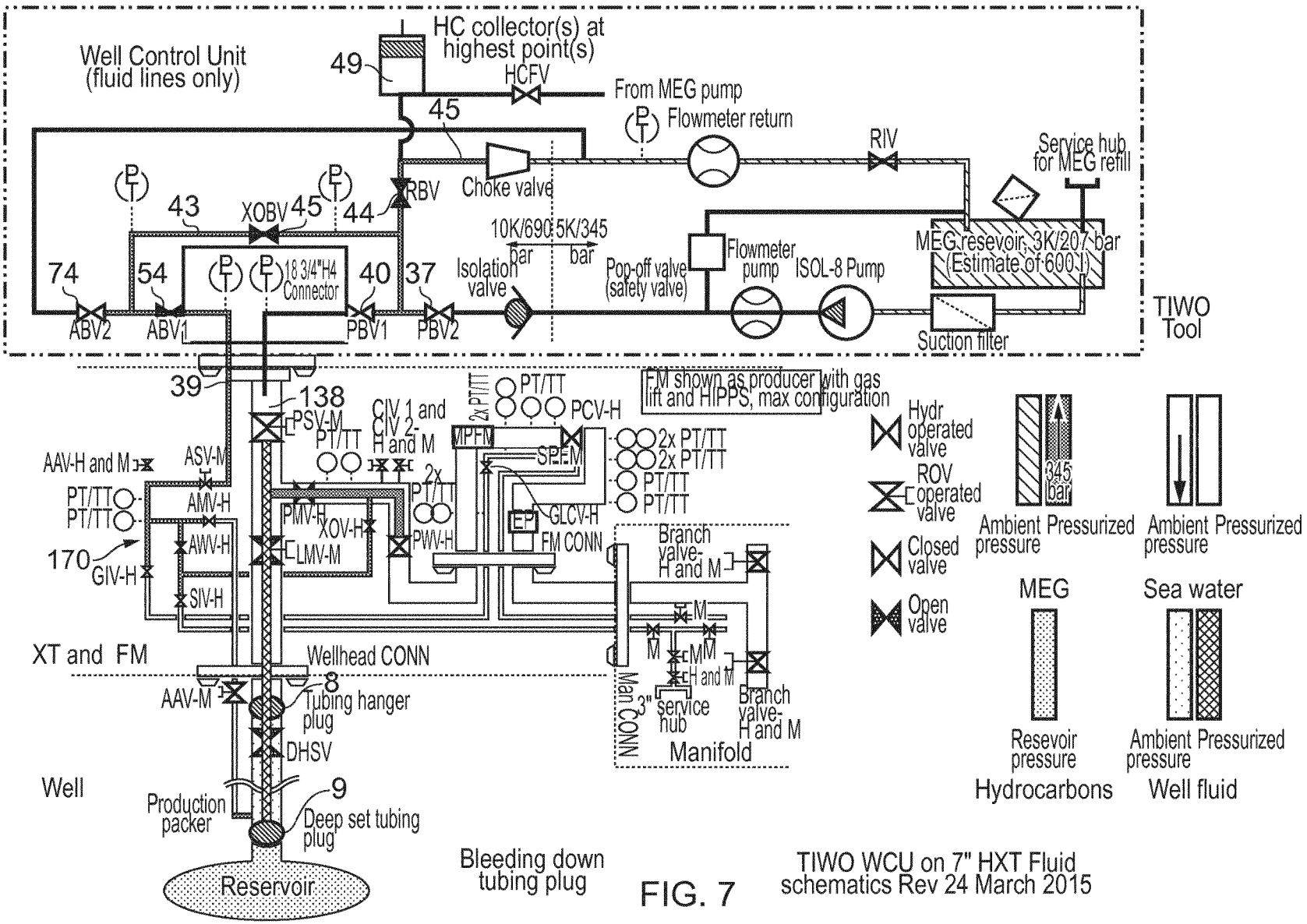
FIG. 7 illustrates the return of fluid from the well interior.

In accordance with a second flow path the pumped fluid is allowed into the X-mas tree annulus bore fluid line 39, see illustration in FIGS. 4 and 6, and returns the fluid through the same X-mas tree annulus bore fluid line 39, see illustration in FIGS. 4 and 7. The X-mas tree annulus bore fluid line 39 leads the fluid to the annulus bore 139 of the X-mas tree 3, as shown in FIG. 6, where the pumped fluid is directed to the X-mas tree main bore 138 by the arrangement of a X-mas tree cross over valve arrangement 170, and further into the interior of the well 10.

When following the first flow path the pumped fluid flows though the X-mas tree main bore fluid line 38 to the well interior. A X-mas tree main bore barrier valve 40 arranged in the pump outlet fluid line 35 is then arranged in an open position. This configuration allows for fluid flow from the pump 30 to the X-mas tree main bore 138 and into the interior of well 10. The pressure and flow of pumped fluid is thereby forwarded to the fluid of the well interior for controlling the opening and closing of down hole equipment such as a barrier arrangement arranged in the well.

A fluid branch 41 diverts from the pump outlet fluid line 35 and is divided into a fluid return line 42 and into a cross over fluid line 43. The fluid return line 42 is arranged with a return barrier valve 44 which is in a closed position as the pumped fluid passes from the pump outlet fluid line 35 through the X-mas tree main bore barrier valve 40 and into the X-mas tree main bore fluid line 38.

The cross over fluid line 43 is arranged with a cross over barrier valve 45 which also is in a closed position as the pumped fluid passes from the pump outlet fluid line 35 to the X-mas tree main bore fluid line 38.

When returning the fluid from the well bore interior after opening or closing the down hole equipment arranged in the well, the X-mas tree main bore barrier valve 40 is in open position. The pump barrier valve 37 and the cross over barrier valve 45 are each in a closed position whereas the return barrier valve 44 is in an open position, thereby allowing the return fluid into the fluid return line 42.

The fluid return line 42 is divided into a fluid source return line 48 and an additional fluid return 46 in fluid connection with a hydrocarbon collector 149 for collection of potential excess hydrocarbon from the well. The additional fluid return line 46 is arranged with flush valve 47 controlling the flushing of the system after completing operations in the well.

The fluid source return line 48 is arranged with a choke valve 49 for controlled reduction of pressure in the return fluid passing in the return line 48 before directing the return fluid to the fluid source 31. An isolation valve 50 is arranged in the fluid source return line 48 providing a possibility for isolation of the fluid source 31. A flow meter 52 is included in the pump outlet fluid line 35 for measuring the characteristic of the pumped fluid.

An excess pressure fluid line 102 arranged with a safety valve 53 connects the pump outlet fluid line 35 and the fluid source return line 48. If the pressure of the pumped fluid exceeds a predetermined value the overpressure is vented to the fluid source through the excess pressure fluid line 102.

When following the second flow path as illustrated in FIG. 6, the pumped fluid is allowed into the X-mas tree annulus bore fluid line 39 by directing the pumped fluid through the fluid branch 41. The pump barrier valve 37 is then in an open position and the X-mas tree main bore barrier valve 40 is in a closed position. From the fluid branch 41 the pumped fluid is diverted into the cross over fluid line 43 by opening the cross over barrier valve 45 and closing the return barrier valve 44. The fluid line 43 splits into a X-mas tree annulus bore connecting line 150 and second connecting line 151 arranged with a second annulus bore barrier valve 74 for fluid connection with a fluid source filling line 55. The X-mas tree annulus bore connecting line 150 is arranged with a first annulus bore barrier valve 54 which is in an open position to let the pumped fluid enter the X-mas tree annulus bore fluid line 39 and into the annulus bore 139 of the X-mas tree 3 (FIG. 6). The second annulus bore barrier valve 74 is closed when the pumped fluid enters the X-mas tree annulus bore fluid line 39.

As explained above the pumped fluid is directed from the X-mas tree annulus bore fluid line 39 to the X-mas tree main bore 138 by the arrangement of a X-mas tree cross over 170, and into the well interior. The pressure and flow of the pumped fluid is thereby forwarded to the fluid of the well interior to open and/or close the down hole equipment for instance a barrier arrangement arranged in the well, the barrier arrangement is shown as tubing hanger plug 8 and a lower set tubing plug 9 in FIG. 6.

When returning the fluid from the well bore interior through X-mas tree main bore 138 via the X-mas tree cross over 170 and into the X-mas tree annulus bore fluid line 39, see FIG. 7. The first annulus bore barrier valve 54 and the cross over barrier valve 45 are both in an open position and the second annulus bore barrier valve 74 is closed, thereby allowing the fluid to return to in the cross over fluid line 43. Further the pump barrier valve 37 and the main bore barrier valve 40 are each in a closed position whereas the return barrier valve 44 is in an open position thereby directing the returning fluid through the fluid return line 42 and into the fluid source return line 48. If excess of hydrocarbon from the well this flows through the additional fluid return line to the hydrocarbon collector 149.

It is also possible to direct the pumped fluid into the X-mas tree main bore fluid line 38 and to return the fluid in the X-mas tree annulus bore fluid line 39. Alternatively to direct the pumped fluid into the X-mas tree annulus bore fluid line 39 and to return the fluid in the X-mas tree main bore fluid line 38.

The fluid source 31 in the example shown in FIG. 4 is shown with connection to the fluid filling point 34, where for instance a fluid line extending from a top side facility is to be attached for filling the fluid source 31. The filling of the fluid source may also be carried out by supplying fluid from the sea floor, for instance from a service line. The first annulus bore barrier valve 54 and the second annulus bore barrier valve 74 are then in open position, whereas the cross over barrier valve 45 is closed. Fluid is withdrawn from the service line (not shown) through the X-mas tree annulus bore fluid line 39 and into the fluid source filling line 55 which is connected to the fluid source return line 48, thereby directing the fluid from the service line to fluid source 31.

The well control unit 23 has a safety control system for shutting down the well including a control unit such as a well shutdown unit 60 and an actuation unit/pressure relief unit, such as quick dump unit 70 which include a quick dump manifold 72 and a control valve 71 (Quick Dump Valve). A control fluid for instance a hydraulic fluid is used to control the opening and closing of the barrier valve in a normal flow mode, wherein the barrier valves are provided as fail safe valves and each is operated by a spring unit 65, 66, 67, 68, 69, 270 71. The flow of control fluid between the manifold 72 of the quick dump unit 70 and the barrier valves is illustrated by fluid lines 1, 2, 3, 4, 5, 6 on the manifold and with fluid lines 1, 2, 3, 4, 5, 6, 7 which each belong to a specific barrier valve 37, 40, 44, 45, 50, 54, 74. The barrier valves have an initial mode which also is a fail safe mode, where the barrier valves are closed. The control fluid is distributed to the actuation chamber/spring chamber of the barrier valve in order to open the barrier valves. When the control fluid in the manifold and the spring chamber exerts a pressure force which exceeds the spring force of the barrier valve, this barrier valve is brought to an open position. If the force provided by the pressure of the control fluid does not exceed the spring force, then the barrier valve remains in a closed position, ie when there is no pressure in the control fluids the valve will be closed, a fail safe closed valve.

Several pressure transducers and or sensors 100 measures the pressure of the fluid in the various fluid lines as shown in FIG. 4. The pressure transducers may also be located elsewhere in the flow path than the shown locations, for examples also in the X-mas tree. The parameter measured by the transducers, for instance pressure, is communicated as input signals 101 to a communication unit 110, which may also be called a safety unit. There are also other sensors in the system providing input signals to the communication unit 110, as for instance flow measurements, of flow into and out of the well and comparing these. If the measured parameters are within a predetermined value or value range, the input signal 101 does not deviate from a signal threshold or a signal range and an output signal QD is transmitted from the communication unit 110 to the control valve 71, which remains in a position where the dumping outlet 75 is closed as illustrated by the no flow symbol 76 on the control valve 71. The fluid flow in the system then follow normal flow mode as described above. It is then possible to keep the barrier valves in an open position, thereby returning fluid to the fluid source 31 following normal flow mode as described above.

If one of the measured parameters deviates, for instance exceeds, from predetermined value or value range the signal input 101 representing the measured parameter deviates from the allowable signal threshold or signal range. No signal QD is then transmitted from the communication unit 110 to the control valve 71, and the safety control system enters a shut down mode. In that case the control valve 71 is brought into a position as shown in FIG. 4 where flow is allowed through the dumping outlet 75. The control fluid is then drained from spring chamber of the spring units belonging to the barrier valves and to the quick dump manifold 72. Fluid dumping from the barrier valve are indicated by arrows on the lines 1, 2, 3, 4, 5, 6 and 7 illustrated on the quick dump manifold 72. The dumping of control fluid from the control unit of the barrier valves causes the barrier valves to close. The barrier valves will then go to a fail state close position containing the well with two barriers in the system both on X-mas tree and the running tool.

As shown the well shut down unit 60 also receives an input signal RC from the ROV. If the ROV communication fails such as when the well shut down unit 60 receives no signal from the ROV, this also initiates no output signal QD being transmitted to the control valve 71, which also initiates the dumping procedure and the barrier valves to go to a fail shut down mode, closing the well as described above. As the skilled person will realize also other parameters than the ones exemplified here, may be used for indicating the status of the system, in which case the absence of signals causes the shut down mode and the presence of signals indicates normal flow mode.

Further the well shut down unit 60 includes a flow comparator 111 where the measurements from the pump flow meter 52 are compared with the measurements from the return flow meter 51. The deviation of measured pump flow and the measured return flow may provides the bases for causing the system to shut down or not. If the measurement of the return flow meter 51 is significantly larger or smaller than the measurement of the pump flow meter 52, when they are supposed to be similar, the input signal 102 is outside the signal threshold or allowable value or value range and no output signal QD is transmitted to the control valve 71. The control fluid keeping the barrier valves in an open position is dumped through the quick dump unit 72 and the barrier valves goes to a fail state closed position closing the well with a double barrier system.

The operator at the topside facility may also initiate this procedure of dumping the control fluid from the spring unit of the barrier valve and thereby operate the well barrier valve to a fail safe close position.

It is within the scope of the invention to have the well shut down unit to communicate with barrier valve in the X-mas tree, to initiate a well shut down and provide a two barrier functionality in the system of X-mas tree and running tool.

It is also within the scope of the invention to have the well shut down unit communicating with barrier valves that are electrically operated or semi-electrically operated, to be kept in an open position, or in a different manner kept in an open position, which when such a signal is lost have the functionality of closing the valve to a fail safe close position to form the barrier for the well on X-mas tree and running tool.

Figure 8:
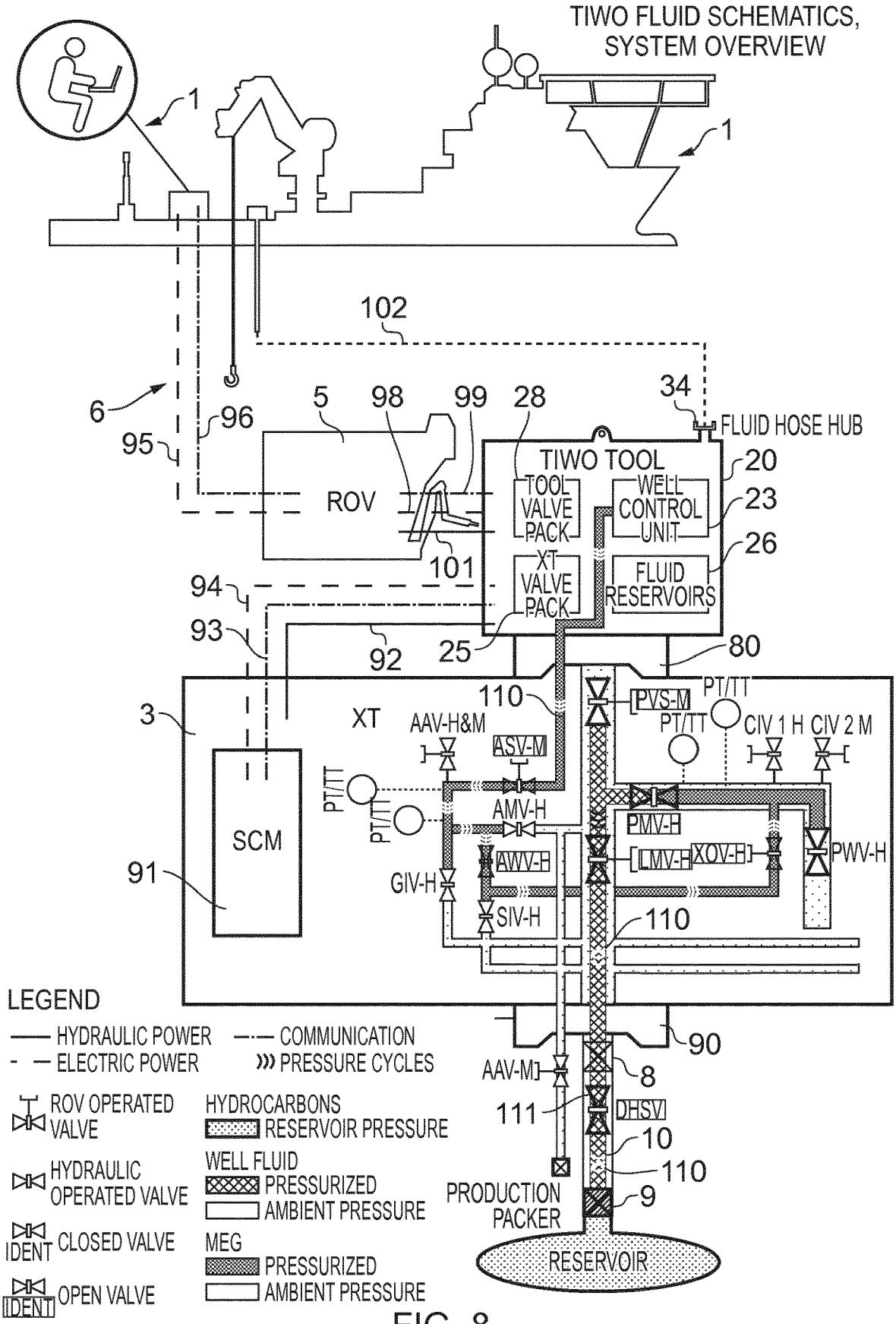
FIG. 8 shows an overall view of the subsea tool connected to the X-mas tree installed on the well head and communication between the subsea tool and top site facility and subsea tool and well interior.

FIG. 8 is a schematic illustration of the interaction between the various components of the overall system and also shows the line of communication between these components. The subsea tool 20 has an outlay similar to the outlay shown in FIG. 3. The flow pattern through the X-mas tree 3 is similar to the flow pattern shown in FIG. 6. FIG. 8 shows the subsea tool 20 connected to the X-mas tree 3 by a tool connector 80 and the X-mas tree 3 connected to the well head by a well head connector 90. Pressure cycles 110 are illustrated provided from the pump on the running tool, see FIG. 4, for operation of the to down hole equipment such as plugs 8, 9 and pressure responsive valve 111. When mentioning components shown in the FIG. 8 that have been discussed earlier the same reference numbers are applied. The X-mas tree 3 has a SCM unit for controlling the valve arrangement of the X-mas tree 3 based on signals from the signal line 93. Line 94 transmits electric power from the subsea tool to the SCM unit of the X-mas tree 3. Fluid line 92 supplies hydraulic power to the X-mas tree 3. The ROV 5 is illustrated with an electric power line 95 and a communication line 96. The lines 95, 96 are included in the ROV umbilical 6 and illustrate the communication between the surface control unit 100 of the vessel 1 and the ROV 5. Additional electric power line 98 and communication line 99 provides a connection from the ROV 5 to the subsea tool 20 and thereby provides the communication between the control unit 100 of the vessel 1 and the subsea tool 20. A fluid line 101 is connected between the ROV and the subsea tool 20. A supply fluid line 102 is also shown illustrating the possibility of filling the fluid source 3 through the fluid filling point 34, as described above when discussing FIG. 4.

Figure 9:
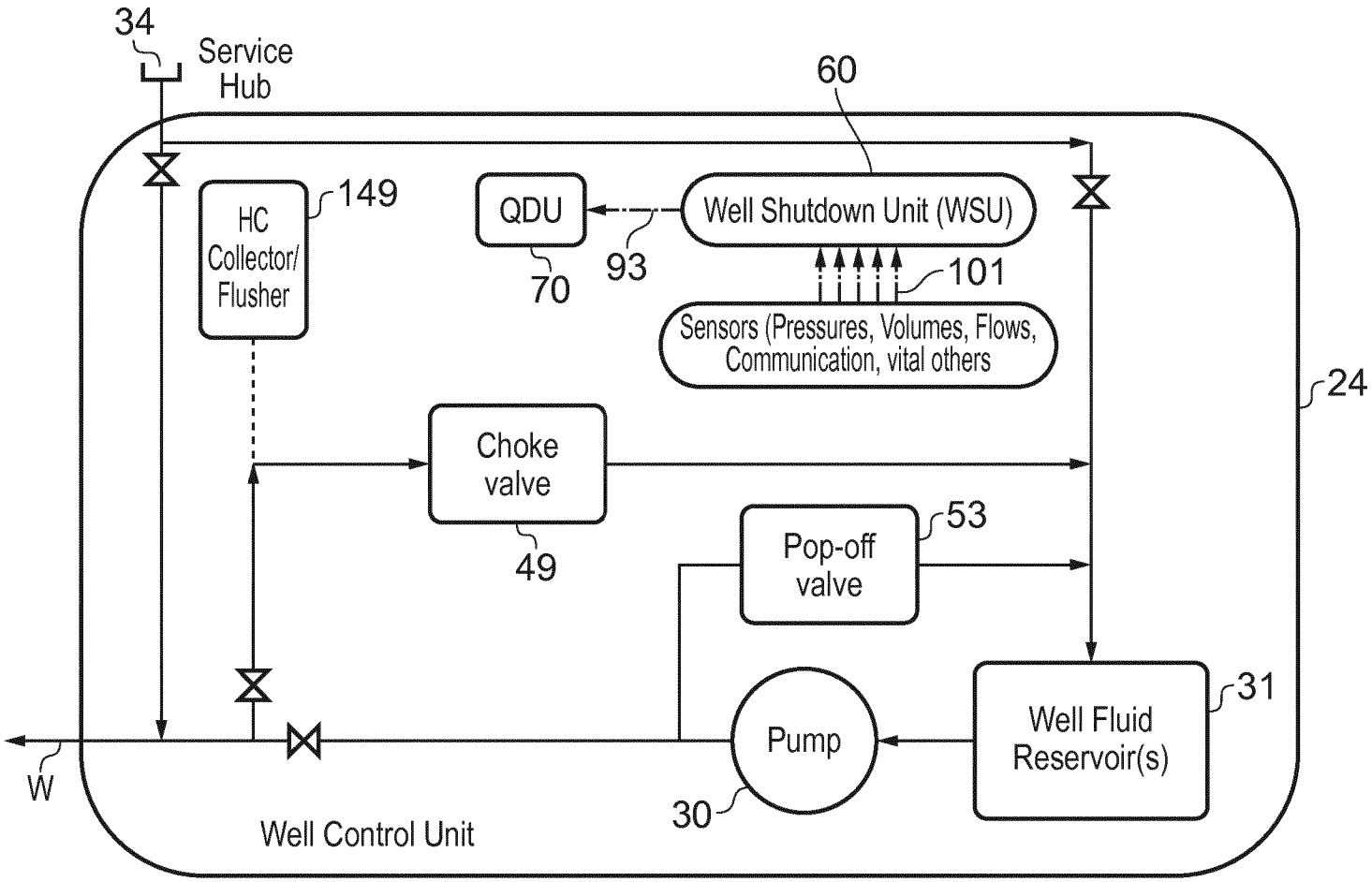
FIG. 9 shows a principle sketch of a well control unit providing a safety control system for a well.
Figure 10:
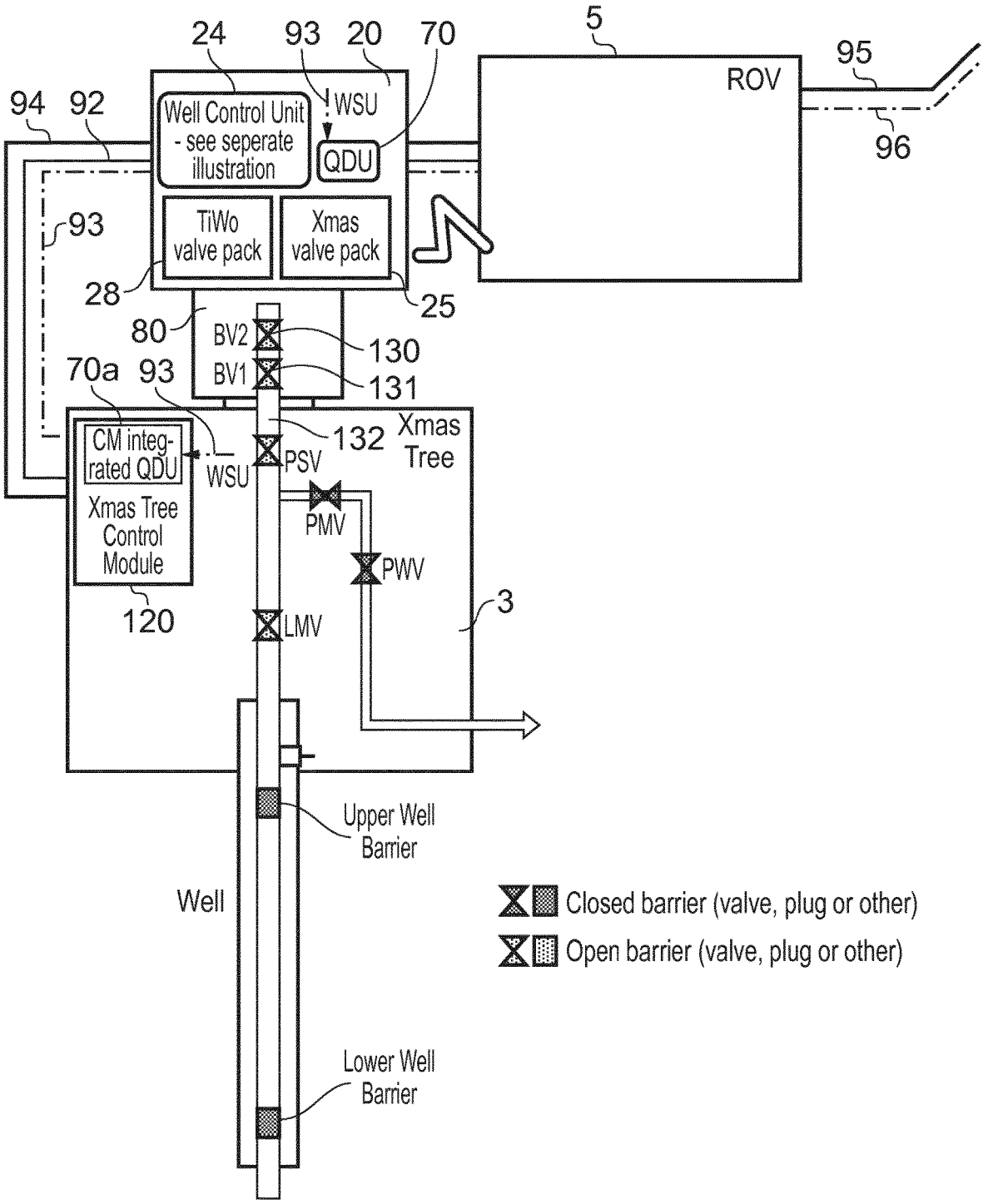
FIG. 10 shows an example of a subsea well opening system where the well control unit is included and positioned on the Xmas Tree
Figure 11:
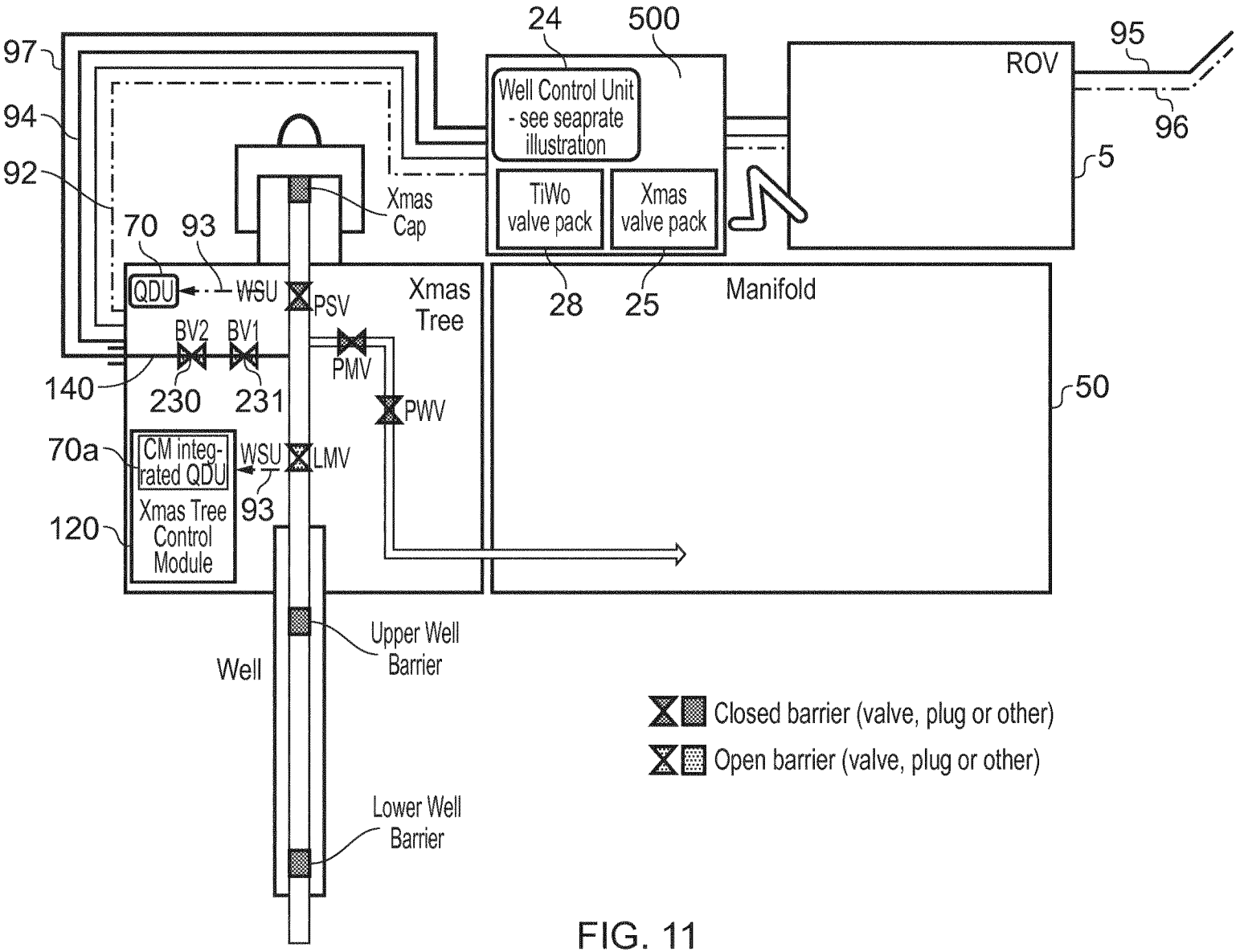
FIG. 11 shows an example of a subsea well opening system including the well control unit and being positioned at the manifold.
Figure 12:
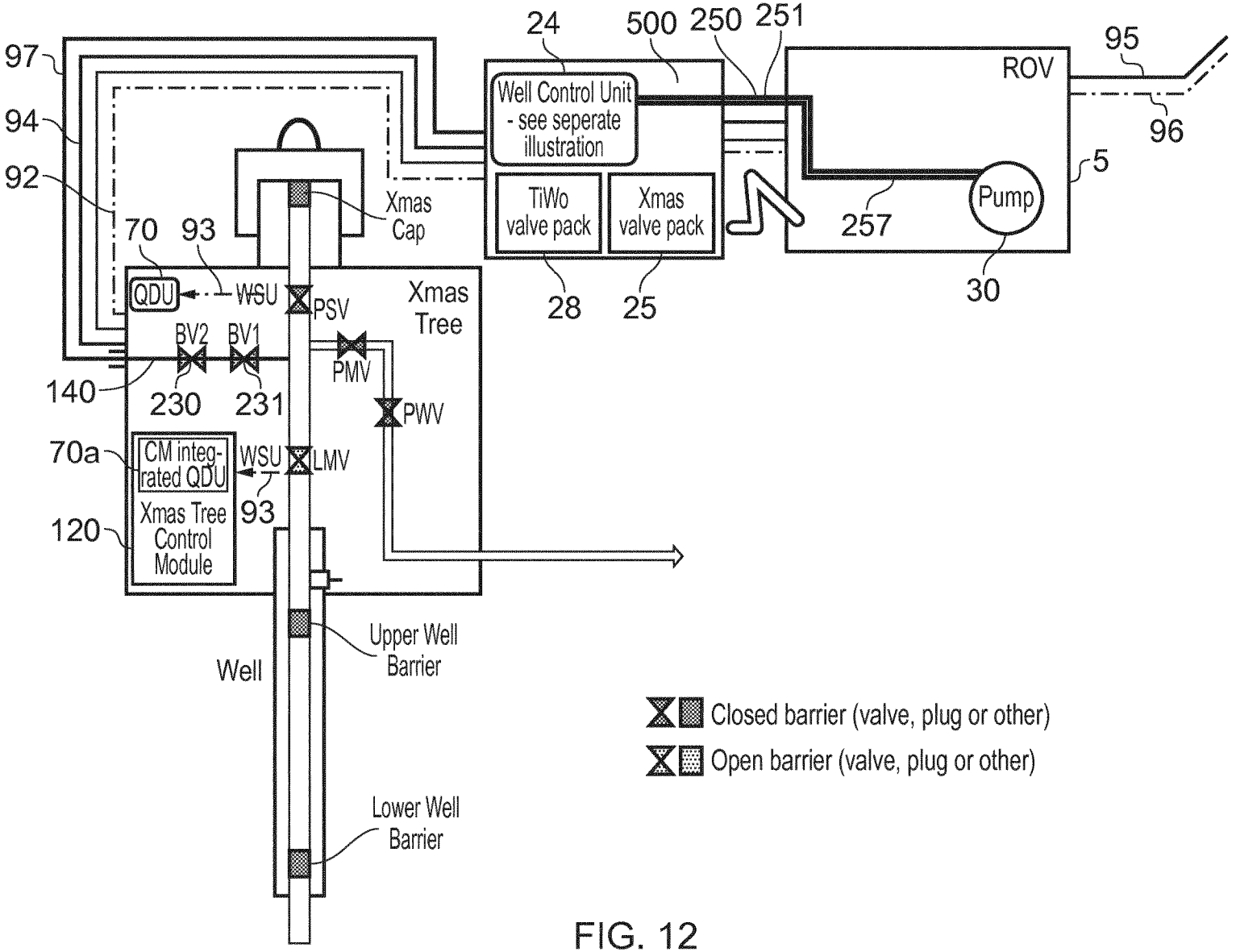
FIG. 12 shows the well opening system including the well control unit and located proximate to the well, and with the pump of the well control unit located on an ROV

FIG. 9 is a schematic illustration of a well control unit 24 provided as a generalized version of the well control unit 23 of FIG. 4. The well control unit 23 of FIG. 4 is shown included in a subsea tool, whereas the well shut down unit 60 and the actuation unit shown as Quick Dump Valve 70 of the well control unit 24 as shown in FIG. 9, may be positioned at various locations. FIGS. 10, 11 and 12 show examples of various locations for positioning the well shut down unit 60 and the Quick Dump Valve 70.

The working principles of the well control unit 24 in FIG. 9 in principle follows the working principle of the well control unit 23 in FIG. 4, and a summarized explanation of the well control unit 24 using the same numbers when referring to components already explained with reference to FIG. 4 follows: The pump 30 draws pumping fluid from the fluid source 31 which may be provided as a well fluid reservoir and forwards the pumped fluid to the X-mas tree (not shown) and from the X-mas tree to the well interior for manipulation of equipment in the well. The pumped fluid entering the X-mas tree is illustrated by arrow W. The pump and the fluid source may be arranged at various locations and the pump and the fluid source may be provided in various ways as described previously in this document.

A safety valve 53 and a arrangement of return fluid lines ensures the ventilation of the pressure of the pumped fluid to the fluid source, should the pumped fluid exceed a predetermined value.

The return fluid from the well interior flows in the direction opposite to that of arrow W and into the return fluid lines directing the return fluid back to the fluid source. A choke valve 49 is provided for controlled reduction of pressure in the return fluid before directing the return fluid to the fluid source 31. Usually an isolation valve (not shown) for isolation of the fluid source 31 and a flow meter (not shown) are also included in these return lines. The isolation valve and the flow meter are shown in FIG. 4.

A hydrocarbon collector 149 is arranged in return fluid lines and in the cases of the excess hydrocarbon from the well, the potential excess hydrocarbon is to be deposited in the hydrocarbon collector 149.

In addition an arrangement for flushing after completing operations in the well is provided.

A service hub provides a fluid filling point 34 for the fluid source 31 and also access for well services such as as injectivity testing, acid stimulations and hydrate remediation.

The signal input 101 from various sensors and the communication signals is illustrated by arrow 93 between the well shutdown unit 60 and the quick dump unit (QDU) 70 for controlling the shut down of a valve arrangement in a subsea position.

As explained above the and the quick dump unit (QDU) 70 is arranged to dump a control fluid from a spring unit (or other pressure source units or mechanisms controlling the opening and closing of the valve) of a valve, thereby causing the valve to go to a fail safe close position.

FIG. 10 shows a skid provided as the subsea tool 20 arranged with the well control unit 24 on the top of the X-mas tree. The subsea tool 20 is connected to the X-mas tree 3 by the tool connector 80. The quick dump unit (QDU) 70 is also shown arranged on the subsea tool 20. In the example in FIG. 10, the subsea tool 20 is provided with barrier valves 130, 131 enabling access to the main bore 132. The barrier valves and the fluid lines may be provided in various ways. The barrier valves 130, 131 are provided as fail safe valves. The well shutdown unit 60 controls the operation of the quick dump unit in (QDU) 70 as illustrated by signal line 93 and thus control the closing of the barrier valves 130, 131 into a fail safe close position to form the barrier for the well in X-mas tree.

Further a quick dump unit (QDU) 70 is shown arranged on the X-mas tree 3. The Quick Dump Unit (QDU) **70*a* on the X-mas tree 3 may be provided by the Quick Dump Unit (QDV) 70*a* of the X-mas tree control module 120. The Quick Dump Unit (QDU) 70, 70*a* arranged X-mas tree 3 may control barrier valves (not shown in FIG. 10) of the on the X-mas tree 3** into fail safe close position to form barrier for the well.

In FIGS. 10, 11 and 12 the Quick Dump Unit 70, **70*a* is shown on the subsea tool 20 and on the X-mas tree 3 for the purpose of illustrating various positions for the Quick Dump Unit 70, 70*a*. This of course does not indicate that the plural Quick Dump Units 70, 70*a*** as illustrated in the figures need to be present at the same time for the working of the well control unit.

FIG. 11 shows the well control unit 24 arranged on a skid 500. The skid 500 is located away from the X-mas tree 3 but proximate to the well and is shown positioned at a manifold 50. The well shutdown unit 60 is arranged on the skid 500, whereas the quick dump unit (QDU) 70 is arranged on the X-mas tree for operating barrier valves 230, 231 of the X-mas tree. The Quick Dump Valve (QDU) 70 on the X-mas tree 3 may be provided by the Quick Dump Valve (QDV) **70*a* of the X-mas tree control module 120**.

The quick dump unit s (QDU) **70*a* of the X-mas tree 3 is provided to operate barrier valves 230, 231** of the X-mas tree into fail safe position.

The barrier valves 230, 231 are shown controlling the fluid flow through annulus bore 140 and enables access to the main bore 130, possibly via a cross over line. A well fluid line 97 is arranged between the subsea tool 20 and the X-mas tree 3.

FIG. 12 shows the well control unit 24 arranged on the skid 500. The skid 500 is located away from the X-mas tree 3 but proximate to the well. The position of the skid 500 as shown in FIG. 12 is meant to illustrate that the skid may be located at other positions than at the manifold 50 as illustrated in FIG. 11. In this embodiment the pump 30 is arranged on the ROV 5. The fluid connection between the pump 30 and the well interior is provided by the fluid lines 250, 251 arranged between the ROV and the subsea tool 20 in combination with the fluid line 97 between the skid 500 and the X-mas tree 3. Alternatively the fluid connection between the pump and the well interior may be provided by fluid lines arranged between the ROV 5 and the X-mas tree 3. The positions of the well shut down unit 60 and the quick dump units 70, 70*a* are the same as in FIGS. 10 and 11.

For the embodiments shown in FIGS. 10, 11 and 12 the well shut down unit 60 may also be arranged to control a combination of barrier valves in the X-mas tree and barrier valves of the subsea tool.

In the preceding description, various aspects of the apparatus according to the invention have been described with reference to the illustrative embodiment. For purposes of explanation, specific numbers, systems and configurations were set forth in order to provide a thorough understanding of the apparatus and its workings. However, this description is not intended to be construed in a limiting sense. Various modifications and variations of the illustrative embodiment, as well as other embodiments of the apparatus, which are apparent to persons skilled in the art to which the disclosed subject matter pertains, are deemed to lie within the scope of the present invention.

The invention claimed is:

1. A system for manipulating equipment in a subsea well and controlling a barrier system for the well, the well comprising a well interior and the equipment being positioned in the well interior and being operable by changes in a pressure and/or flow of a fluid in the well interior, the system comprising:

a subsea pump which is connected to the well interior through at least one of a main bore and an annulus bore of a X-mas tree mounted over the well interior to thereby define a closed system with the well interior which is suitable for pressure and flow regulation for operation of the equipment;

a fluid source for supplying a fluid to the subsea pump;

wherein in one mode of operation the subsea pump regulates at least one of a flow and a pressure of the fluid through at least one of the main bore and the annulus bore of the X-mas tree to thereby operate the equipment in the well interior;

a safety control system for controlling shut down of a valve arrangement for the well, the valve arrangement being located subsea, and the safety control system being located subsea and comprising a control unit and an actuation unit for local control and operation of the valve arrangement;

wherein the control unit operates the actuation unit to close the valve arrangement and thereby provide a barrier system between a reservoir in fluid communication with the well interior and an environment external to the well interior; and a plurality of sensors which are configured to measure a number of parameters of the fluid and to transmit signals representative of the parameters to the control unit, wherein the control unit is configured such that when at least one parameter deviates from an allowable value, the control unit activates the actuation unit to close the valve arrangement.

2. The system in accordance with claim 1, wherein the control unit is provided on a skid positioned on the top of a X-mas tree which is connected to the well.

3. The system in accordance with claim 1, wherein the control unit is provided on a skid which is located proximate the well but positioned away from a X-mas tree which is connected to the well.

4. The system in accordance with claim 1, wherein the control unit is provided on a skid which is positioned at a manifold that is fluidly connected to the well.

5. The system in accordance in accordance with claim 1, wherein the actuation unit is located in a X-mas tree control module and is in communication with the control unit.

6. The system in accordance with claim 1, wherein the actuation unit comprises a quick dump valve unit for dumping a control fluid from an actuator of at least one valve of the valve arrangement, thereby causing the valve to go to a fail safe close position.

7. The system in accordance with one of claims 2-4, wherein the skid comprises a subsea tool.

8. The system in accordance with claim 1, wherein the valve arrangement comprises a barrier valve for a X-mas tree which is connected to the well, and wherein control and operation of the barrier valve is carried out by the control unit and the actuation unit.

9. The system in accordance with claim 1, wherein at least one valve of the valve arrangement is located on a subsea tool which is temporarily connected to the well.

10. The system in accordance with claim 1, wherein the control unit is configured to receive operation signals from a topside location through one of an umbilical or a wireless system.

11. The system in accordance with claim 10, wherein the control unit is configured to receive the signals through a communication system of an ROV which is connected to the control unit during operation.

12. The system in accordance with claim 1, wherein the pump is located on an ROV and the fluid connection is provided by fluid lines extending between the ROV and the well interior.

13. The system in accordance with claim 1, wherein the control unit is located on an ROV.

14. A method for manipulating equipment in a subsea well and controlling a barrier system for the well, the well comprising a well interior and the equipment being positioned in the well interior and being operable by changes in a pressure and/or flow of a fluid in the well interior, the method comprising:

providing a pump subsea proximate to the well and a fluid source for supplying fluid to the pump;

establishing a fluid connection for fluid flow between the pump and the well interior through at least one of a main bore and an annulus bore of a X-mas tree mounted over the well interior to thereby define a closed system with the well interior which is suitable for pressure and flow regulation for operation of the equipment;

operating the pump to regulate at least one of a flow and a pressure of the fluid through at least one of the main bore and the annulus bore of the X-mas tree to thereby control the operation of the equipment in the well interior;

providing a temporary safety control system at a subsea location, the safety control system comprising a control unit and an actuation unit for locally controlling and operating a valve arrangement which is positioned subsea;

wherein the control unit operates the actuation unit to close the valve arrangement and thereby provide a barrier system between a reservoir in fluid communication with the well interior and an environment external to the well interior;

providing the control unit with signals representing measured parameters of the fluid, and when at least one parameter deviates from an allowable value, operating the actuation unit to close the valve arrangement.

15. The method in accordance with claim 14, wherein the equipment in the well comprises a barrier assembly; and wherein in one mode of operation the pump generates a pressure in the well which is necessary to open the barrier assembly.

16. The system in accordance with claim 7, wherein the subsea tool comprises a running tool for a X-mas tree.

* * * * *